US012168498B2

(12) United States Patent
Cordery

(10) Patent No.: US 12,168,498 B2
(45) Date of Patent: Dec. 17, 2024

(54) REMOVABLE SEAT FOR WATERCRAFT

(71) Applicant: Michael Cordery, Tallebudgera (AU)

(72) Inventor: Michael Cordery, Tallebudgera (AU)

( * ) Notice: Subject to any disclaimer, the term of this patent is extended or adjusted under 35 U.S.C. 154(b) by 120 days.

(21) Appl. No.: 17/045,172

(22) PCT Filed: Apr. 5, 2019

(86) PCT No.: PCT/AU2019/050301

§ 371 (c)(1),
(2) Date: Oct. 4, 2020

(87) PCT Pub. No.: WO2019/191813

PCT Pub. Date: Oct. 10, 2019

(65) Prior Publication Data

US 2021/0155324 A1 May 27, 2021

(30) Foreign Application Priority Data

Apr. 6, 2018 (AU) ..... 2018901139
Jun. 13, 2018 (AU) ..... 2018902102

(51) Int. Cl.

| | |
|---|---|
| ***B63B 34/26*** | (2020.01) |
| ***B63B 3/48*** | (2006.01) |
| ***B63B 29/04*** | (2006.01) |
| ***B63B 34/21*** | (2020.01) |
| *B63B 29/06* | (2006.01) |

(52) U.S. Cl.

CPC ..... *B63B 34/26* (2020.02); *B63B 3/48* (2013.01); *B63B 29/04* (2013.01); *B63B 34/21* (2020.02); *B63B 2029/043* (2013.01); *B63B 29/06* (2013.01)

(58) Field of Classification Search

CPC ..... B63B 34/26; B63B 3/48; B63B 29/04; B63B 34/21; B63B 29/06; B63B 2029/043; B63B 32/56

See application file for complete search history.

(56) References Cited

U.S. PATENT DOCUMENTS 5,988,475 A * 11/1999 Han ..... A45F 3/14 224/608
2007/0012236 A1* 1/2007 Caples ..... B63B 34/20 114/347

* cited by examiner

*Primary Examiner* — Andrew Polay
(74) *Attorney, Agent, or Firm* — Patwrite Law; Mark David Torche

(57) ABSTRACT

This invention relates a removable seat for watercraft 10 of the type having a hull or underside 13 and a deck 14, and wherein the deck is connected to the hull by side portions or rails 15, and said deck includes retaining means in the form of one or more recesses 20 formed in or attached to the deck. The seat includes a seat base 112 and a backrest 111, and anchoring means 130 connected to structural means supporting said backrest, said anchoring means extending generally away from a lower portion of said backrest and a rear portion of said seat base, and wherein said anchoring means is locatable within a respective one of the retaining means 20. The seat is retained in an operative attitude by first releasable securing means connected to an upper part of said backrest and connectable to a location on the deck or the rails generally forward of the seat, and second releasable securing means connected to an upper portion of said backrest and connectable to a location on the deck or the rails generally rearward of said seat.

13 Claims, 21 Drawing Sheets

Top View

Bottom View

Side View

Perspective Side View

Perspective Top View

Perspective Bottom View

Underside View 135
137b
170
140
138
210
137a
171
136
139
128
130
129
127
120
121

Perspective Side Views

Top View

Bottom View

Side View

REMOVABLE SEAT FOR WATERCRAFT

This invention relates to a removable seat for watercraft.

This invention has particular, but not exclusive, application to removable seats having a backrest and a seat base for sit on top kayaks, and wherein reference will be made to same. However, it will be appreciated that the seat may have other applications where it is desirous to have interchangeable seats, such as other watercraft, including folding kayaks and canoes.

Sit on top kayaks typically include a substantially hollow body made from a plastics material that includes a bow and a stern, a hull or underside, and a deck or top side, and wherein the deck is connected to the hull by opposing rails.

The deck may include a seat portion on which a paddler may sit that is located partway between the bow and the stern, and wherein the seat portion may have a shape that generally conforms to the shape of a paddler's buttocks. The seat portion may be further located within a recess formed in the deck, such as a cockpit, and wherein a plurality of scuppers may be formed in the rails to allow water contained in the cockpit to drain therefrom.

The deck may also include one or more abutments located in front of the seat for supporting a paddler's feet. For example, the deck may include two footwells formed therein that are each adapted to receive a respective one of the paddler's feet, and wherein each footwell may include an inclined wall for the paddler's foot to push against.

For comfort, some paddlers prefer to attach to their kayak a removable seat having a seat base, which is preferably padded, that is adapted to generally overlie the kayak's seat portion, and a backrest that extends upwardly from, and is pivotally connected to, the seat base. The removable seat is connected to the kayak by two forward extending and one or two aft extending stays that also help to maintain the backrest in a preferred operable position relative to the deck.

The two forward extending stays each have a fixed end portion that is connected to a respective one of two opposing side portions of the back rest and a free end portion that is releasably connected to a respective fitting, such as a pad eye, attached to an adjacent rail, or the deck adjacent said rail.

The two aft extending stays also each have a fixed end portion that is connected to a respective opposing side portion of the back rest and a free end portion that is releasably connected to a respective fitting, such as a pad eye, attached to an adjacent rail, or the deck adjacent said rail.

Where there is only one rear stay, the fixed end of the rear stay is typically connected to opposing side portions of the back rest by diverging straps and wherein the free end portion of the single stay is releasably connected to a fitting connected to the deck midway between opposing rails.

The forward and aft stays in combination with one another pull the base of the backrest down into the seat portion of the kayak and help maintain the top of the backrest in a preferred position relative to the bow and stern of the kayak.

However, it has been observed, when a paddler leans back against the backrest, such that at least some of their weight is transferred from the seat base to the backrest, on some occasions the seat base will slide relative to the deck in a generally forward direction causing wear to the underside of the seat base, and whereby the backrest may partially collapse, possibly causing irreparable structural damage thereto.

It is therefore an aim of the present invention to provide a removable seat for watercraft which will alleviate at least some of the disadvantages of the prior art.

With the foregoing and other objects in view, this invention relates to a removable seat for watercraft of the type having a hull or underside and a deck, and wherein the deck is connected to the hull by side rails, and said deck includes retaining means in the form of one or more recesses formed in or attached to the deck, said seat including:

- a seat base;
- a backrest that is connected to said seat base such that said backrest may generally pivot relative to said seat base;
- structural means associated with said back rest for maintaining a preferred shape of said backrest;
- anchoring means connected to said structural means, said anchoring means extending generally away from a lower portion of said backrest and a rear portion of said seat base, said anchoring means being locatable within the retaining means, and
- fore and aft securing means that is attached to an upper portion of said backrest for securing said backrest to the watercraft so as to maintain said backrest in a preferred operable attitude relative to the deck.

In another aspect, this invention relates to a watercraft and a removable seat for said watercraft including:

- a hull or underside;
- a deck that is connected to said hull;
- retaining means in the form of one or more recesses formed in or attached to said deck;
- a seat base supported on said deck;
- a backrest that is connected to said seat base such that said backrest may generally pivot relative to said seat base;
- structural means associated with said backrest for maintaining a preferred shape of said backrest;
- anchoring means connected to said structural means, said anchoring means extending generally away from a lower portion of said backrest and a rear portion of said seat base, said anchoring means being locatable within said retaining means, and
- fore and aft securing means that is attached to an upper portion of said back rest for securing said backrest to said deck so as to maintain said backrest in a preferred operable attitude relative to said deck.

The backrest may include an upper or top edge portion, a lower or bottom edge portion and two opposing side portions.

The backrest preferably also includes structural means for maintaining the backrest in a preferred or operable shape and wherein at least some of the structural means may be contained within a pocket of the backrest.

For example, the structural means may include a frame assembly that is adapted to provide structural support for the backrest and possibly also means for connecting the backrest to the seat base.

Alternatively, in another embodiment, the structural means may include two elongate stiffening members and wherein the stiffening members may each be retained in a respective pocket that extends at least partway between the top edge portion and the bottom edge portion, and preferably adjacent a respective side portion of the backrest. Further, each stiffening member may be made from steel, wood, carbon fibre or a suitable plastics material.

The anchoring means may further include one or more supports that depend from the structural means and which extend below the bottom edge portion of the back rest. For example, where the structural means includes a frame assembly, each support may include a supporting member that depends from a lower frame member. Alternatively, where the structural means includes two elongate stiffening members, each support may comprise a lower end portion of a stiffening member.

Further, the lower or free end portion of each support, or a fitting attached thereto, may be adapted to engage with suitable retaining means in a manner such that the anchoring means may move relative to the retaining means in a generally fore and aft direction, that is to say, in the direction of the bow and stern of the watercraft. For example, the anchoring means and the retaining means may form a loose fit.

Alternatively, the anchoring means and the retaining means may include complementary shaped engaging portions. For example, the anchoring means and the retaining means may form a ball and socket joint, hinge joint or saddle joint.

The retaining means may comprise a recess that is formed in the seat portion of the deck or a fitting having a recess that is located in a suitable opening or recess that has been formed in the deck, such as during manufacture of the watercraft.

The fore and aft securing means may include flexible stays, such as straps, and wherein the effective length of the straps may be selectively varied by the inclusion of one or more buckles.

Each strap may include a fixed end portion that is attached to the backrest and a free end portion that includes a connector for releasably connecting the free end portion to the watercraft. For example, the connector may include a hook that is adapted to engage a pad eye.

However, in other embodiments, the connector may include an enlarged end portion that in use shall be retained behind a slotted opening of a suitable fitting. For example, the connector may include a body having an opening formed therein through which the strap may pass and a generally spherically shaped free end portion that is connected to said body by a stem. The spherical end portion may be retained behind a wall of a suitable fitting in which there is formed an open ended slot that is adapted to receive the stem and wherein the fitting further includes an opening that is adapted to receive the spherical end portion, said opening being in communication with an inverted channel that is at least partly defined by said wall.

In another aspect, this invention relates to a watercraft having:

- a hull or underside;
- a deck that is connected to said hull by opposing side portions or rails;
- a seat portion having a peripheral edge portion formed in or attached to said deck on which a paddler may sit, and
- at least one recess that is capable of receiving anchoring means that is connected to structural means of a backrest of a seat, said recess being located in the deck and either adjacent to or in said seat portion.

The recess may be formed in the deck during manufacture of the watercraft. For example, the watercraft may be manufactured using a plastics moulding process and wherein the recess may be formed by a suitably shaped plug, or such like, in the mould used to create the deck and/or seat portion. Alternatively the recess may be formed in an insert that is locatable within an opening, such as a cavity, that is formed in the deck or seat portion.

Preferably the recess is located in the seat portion and towards the rear of the seat portion.

Preferably the recess and the anchoring means include complimentary shaped portions.

In another aspect, this invention relates to anchoring means for securing a removable seat of the type having a backrest that includes structural means for maintaining the shape of the backrest, and a seat base, to a watercraft having a deck in which there is a seat portion, and a recess located in the deck adjacent to or in the seat portion, said anchoring means including:

- a body having a first engagement portion that is adapted to engage or be connected to the structural means of the back rest, and
- a second engagement portion that extends generally away from a lower portion of the backrest and a rear portion of the seat base, said second engagement portion being receivable within a recess of the watercraft.

Preferably the anchoring means is a stiffening member having a first engagement free end portion that is locatable within a pocket of the backrest and a second engagement portion that is locatable in the recess. Further, the external profile of the second end portion and the shape of the recess may be complimentary.

Preferably the recess and the second engagement portion include complimentary shaped portions.

The first engagement portion may include attachment means for attaching aft securing means thereto.

In another aspect, this invention relates to a method of assembling a watercraft, said method including:

providing a watercraft having:

- a hull or underside;
- a deck that is connected to said hull by opposing side portions or rails;
- a seat portion on which a paddler may sit, said seat portion being formed in or attached to said deck and wherein said seat portion includes a peripheral edge portion;
- and a recess for a removable seat, said recess being in the deck and located either adjacent to or in said seat portion;
- providing a removable seat having a backrest that includes structural means for maintaining the shape of the backrest, a seat base that is connected to the backrest, and forward and aft stays each having one end that is connected to the backrest and a free end having connecting means, said seat further including anchoring means for securing the removable seat to the watercraft, said anchoring means including:
- a body having a first engagement portion that is connected to the structural means of the back rest, and
- a second engagement portion that extends generally away from a lower portion of the backrest and a rear portion of the seat base, said second engagement portion being receivable within the recess of the watercraft;
- locating the second engagement portion in the recess;
- securing the free ends of the forward and aft stays to the deck or rails using the connecting means.

In another aspect, this invention relates to a fitting for creating a recess in a wall of a hull of a watercraft, said wall having an inner face and an outer face and an aperture formed in said wall, said fitting including:

- an inner mount that is locatable within the hull such that at least a portion thereof may abut against the inner face of the wall, said inner mount having two opposed jaws and a mouth located therebetween, said inner mount also being provided with a first set of mounting apertures and a second set of mounting apertures;
- a plug that includes an open topped receptacle having an opening, and a peripheral flange surrounding said opening, said flange being provided with a first set of apertures and a second set of apertures, said first set of apertures being aligned with said first set of mounting apertures and said second set of apertures being aligned with set second set of mounting apertures, and wherein said receptacle is locatable within said mouth of said inner mount;

a seal made from a deformable material, said seal being generally plate like and having an opening formed therein that is capable of receiving said receptacle, and a cap having a top wall and a skirt depending from said top wall which in combination form a recess that is adapted to receive said peripheral flange of said plug and at least a portion of said seal, said cap further including an access opening formed in said top wall that in use shall provide access to said receptacle, and a first set of apertures that are aligned with said first set of mounting apertures.

In another aspect, this invention relates to a recess in a wall of a hull of a watercraft, and wherein the wall includes an opening, said wall having an inner face and an outer face, said recess including:

an inner mount located within the hull such that at least a portion thereof abuts against the inner face of the wall, said inner mount having two opposed jaws and a mouth located therebetween, said inner mount also being provided with a first set of mounting apertures and a second set of mounting apertures, said inner mount being secured to the wall of the kayak by a plurality of threaded fasteners which each extend through an aperture formed in the wall and a respective one of said second set of mounting apertures;

a seal made from a deformable material, said seal being generally plate like and having an opening formed therein;

a plug that includes an open topped receptacle having an opening, and a peripheral flange surrounding said opening, said flange being provided with a first set of apertures, whereby at least a portion of said receptacle extends through said opening in said seal, and extends through the opening in said kayak wall and extends through said mouth of said inner mount, and whereby said first set of apertures is aligned with said first set of said mounting apertures; and a cap having a top wall and a skirt depending from said top wall which in combination form a recess that is adapted to receive said peripheral flange of said plug and at least a portion of said seal, said cap further including an access opening formed in said top wall that in use shall provide access to said receptacle, and a first set of apertures that are aligned with said first set of apertures of said peripheral flange and said first set of mounting apertures, said cap being secured to said inner mount by a plurality of threaded fasteners that each extend through a respective one of said first set of apertures in said cap, said first set of apertures in said flange and said first set of mounting apertures of said inner mount.

In still yet another aspect, this invention relates to a method of forming a recess in a wall of a hull of a watercraft, said wall having an inner face and an outer face, said method including, forming an aperture in the wall;

providing a fitting of the type that includes:

an inner mount that is locatable within the hull such that at least a portion thereof may abut against the inner face of the wall, said inner mount having two opposed jaws and a mouth located therebetween, said inner mount also being provided with a first set of mounting apertures and a second set of mounting apertures;

a plug that includes an open topped receptacle having an opening, and a peripheral flange surrounding said opening, said flange being provided with a first set of apertures and a second set of apertures, said first set of apertures being aligned with said first set of mounting apertures and said second set of apertures being aligned with set second set of mounting apertures, and wherein said receptacle is locatable within said mouth of said inner mount;

a seal made from a deformable material, said seal being generally plate like and having an opening formed therein that is capable of receiving said receptacle, and a cap having a top wall and a skirt depending from said top wall which in combination form a recess that is adapted to receive said peripheral flange of said plug and at least a portion of said seal, said cap further including an access opening formed in said top wall that in use shall provide access to said receptacle, and a first set of apertures that are aligned with said first set of mounting apertures;

placing the receptacle in the hole such that at least a portion of the flange abuts against the upper face and using the openings in the flange as a template to identify the preferred location of a first set of apertures and a second set of apertures in the wall;

forming said first set of apertures and said second set of apertures in the wall;

locating the inner mount within the kayak hull such that at least a portion of said inner mount abuts against the inner face and said mouth and said hole are generally aligned;

securing the inner mount to said wall using a plurality of threaded fasteners that each extend through a respective one of said second apertures in the wall and a respective one of said second mounting apertures;

locating said seal on said plug such that said receptacle extends through said opening in said seal;

positioning said receptacle in said hole such that it extends into said mouth of said inner mount and whereby said first apertures in said flange are aligned with said first mounting apertures and said seal abuts against the outer face of the wall;

placing said cap on top of said plug such that said flange of said plug and said seal are at least partially contained within said recess;

securing said cap to said inner mount using a plurality of threaded fasteners that each extend through a respective one of said first set of apertures in said cap, said first set of apertures in said flange and said first set of mounting apertures of said inner mount.

In another aspect, this invention relates to a fitting for creating a recess in a wall of a hull of a watercraft, said wall having an inner face and an outer face and an aperture formed in said wall, said aperture being surrounded by a peripheral edge portion, said fitting including:

an inner mount that is locatable within the hull such that at least a portion thereof may abut against the inner face of the wall, said inner mount having two opposed jaws that are interconnected by an intermediate portion and a mouth located between said jaws, said inner mount being provided with a first set of mounting apertures, said inner mount also being provided with locating means for initially locating said inner mount on the peripheral edge portion and retaining means for retaining said inner mount in an operative position on the peripheral edge portion;

a seal made from a deformable material, said seal being generally plate like and having an opening formed therein;

a plug that includes an open topped receptacle having an opening, and a peripheral flange surrounding said opening, said flange being provided with a second set of mounting apertures that may be aligned with the first set of mounting apertures and wherein said receptacle is locatable within said mouth of said inner mount, and a cap having a top wall and a skirt depending from said top wall which in combination form a recess that is adapted to receive said peripheral flange of said plug and at least a portion of said seal, said cap further including an access opening formed in said top wall that in use shall provide access to said receptacle, and a third set of mounting apertures that may be aligned with said first and said second mounting apertures.

Preferably the fitting is retained in an operative position on the wall by a plurality of threaded fasteners that each extend through an aligned first, second and third mounting aperture and a mounting aperture in the peripheral edge portion.

The fitting may include first alignment means associated with the inner mount and the plug for ensuring that the first and second mounting apertures are aligned when the receptacle is located in the mouth of the inner mount. For example, the receptacle may include an exterior face in which there is formed a plurality of grooves and wherein the inner mount may include a plurality of protrusions that are adapted to engage a respective one of said grooves.

Similarly, the fitting may include second alignment means associated with the plug and the cap for ensuring that the second mounting apertures and the third mounting apertures are aligned when the peripheral flange is located within the cap's recess. For example, the cap may include a protrusion that depends from an inner face of the top wall and wherein the protrusion may be locatable in a notch formed in the peripheral flange of the plug.

The inner mount may include an abutment face that is adapted to abut against the inner face of the wall and an opposing second face.

Preferably the inner mount is resilient such that at least some of the abutment face may abut the inner face of the wall, when the inner mount is in its operative position. Further, because of the resilient nature of the inner mount, preferably the two jaws are capable of movement generally towards one another and also generally parallel to one another.

Preferably the locating means includes first locating means associated with a first one of the two jaws for locating that first jaw on the peripheral edge portion and whereby there may be provided second locating means associated with the second jaw, and whereby the first and second locating means in combination with the resilient nature of the inner mount may assist in retaining the inner mount in a temporary position on the peripheral edge portion.

For example, the first locating means may include one or more hook like portions that extend generally upwardly or away from first jaw. Similarly, the retaining means may include the hook like projections associated with the first jaw and at least one hook like projection associated with the second jaw.

Preferably the location of the receptacle in the mouth of the inner mount will prevent or inhibit the disengagement of the inner mount from the wall. For example, the first alignment means may include a plurality of grooves formed in an external face of the receptacle and wherein each groove is adapted to receive a respective one of the hook like alignment means and whereby their retention within a groove shall prevent the location means from disengaging the peripheral wall portion.

The second jaw may be further provided with gripping means, such as a flange that depends from said second jaw, that a user may engage, such as with their finger, so that they may urge the second jaw generally towards the first jaw.

The access opening may be adapted to receive anchoring means associated with a back rest of a removable seat for watercraft and wherein the seat may further include a seat base that may pivot relative to the back rest. Further, because it is desirable that the backrest pivot in a generally fore and aft direction relative to the watercraft, the access opening may resemble an elongate slot having two substantially parallel sides that help to guide movement of the anchoring means located therein and thereby movement of the back rest relative to the watercraft.

Bearing the above in mind, preferably the first and second alignment means in combination with the location means and the retaining means, will permit a user to rotate the fitting relative to the wall about an axis passing through the access opening and the receptacle, said access being generally transverse to the wall in the vicinity of the centre of the aperture. This will enable the user to correctly align the access opening relative to the bow and stern of the watercraft, or some other reference, such as the centre line of the watercraft or line that is offset from the centreline.

To assist with the alignment of the fitting, the cap may include a mark formed therein or applied thereto that is indicative of a preferred orientation of the fitting relative to the object to which it is fitted, such as a rib on the external surface of the skirt or a notch in the skirt.

In another aspect, this invention relates to a watercraft having:

a hull that includes a wall having an inner face and an outer face and an aperture formed in said wall, said aperture being surrounded by a peripheral wall portion, and a fitting for creating a recess in said wall, including:

an inner mount that is located within said hull such that at least a portion thereof abuts against said inner face of said wall, said inner mount having two opposed jaws that are interconnected by an intermediate portion and a mouth located between said jaws, said inner mount being provided with a first set of mounting apertures, said inner mount also being provided with locating means for initially locating said inner mount on the peripheral edge portion and retaining means for retaining said inner mount in an operative position on said peripheral edge portion;

a seal made from a deformable material, said seal being generally plate like and having an opening formed therein;

a plug that includes an open topped receptacle having an opening, and a peripheral flange surrounding said opening, said flange being provided with a second set of mounting apertures that are aligned with said first set of mounting apertures and wherein said receptacle is located within said opening of said seal and within said aperture and said mouth such that said seal seals against said upper face of said wall, and a cap having a top wall and a skirt depending from said top wall which in combination form a recess in which is located said peripheral flange and at least a portion of said seal, said cap further including an access opening formed in said top wall that in use shall provide access to said receptacle, and a third set of mounting apertures that are aligned with said first and said second mounting apertures, said cap being secured to said wall be a plurality of fasteners which each end through a respective mounting aperture formed in said wall and respective ones of said first, second and third mounting apertures.

The fasteners are preferably threaded fasteners, such as screws.

In still yet another embodiment, this invention relates to a method of forming a recess in a wall of a hull of a watercraft, said wall having an inner face and an outer face, said method including, forming an aperture in the wall;

providing a fitting of the type that includes:

an inner mount that is locatable within the hull such that at least a portion thereof may abut against the inner face of the wall, said inner mount having two opposed jaws that are interconnected by an intermediate portion and a mouth located between said jaws, said inner mount being provided with a first set of mounting apertures, said inner mount also being provided with locating means for initially locating said inner mount on the peripheral edge portion and retaining means for retaining said inner mount in an operative position on the peripheral edge portion;

a seal made from a deformable material, said seal being generally plate like and having an opening formed therein;

a plug that includes an open topped receptacle having an opening, and a peripheral flange surrounding said opening, said flange being provided with a second set of mounting apertures that may be aligned with the first set of mounting apertures and wherein said receptacle is locatable within said mouth of said inner mount, and a cap having a top wall and a skirt depending from said top wall which in combination form a recess that is adapted to receive said peripheral flange of said plug and at least a portion of said seal, said cap further including an access opening formed in said top wall that in use shall provide access to said receptacle, and a third set of mounting apertures that may be aligned with said first and said second mounting apertures;

taking the inner mount and firstly locating the peripheral edge portion between the opposed jaws and then rotating the inner mount relative to the wall until the inner mount is located inside the hull;

engaging the first locating means with the peripheral edge portion such that the inner mount is retained in a temporary position relative to said wall;

pulling the second jaw towards the first jaw until the retaining means engages the wall;

locating the receptacle within the opening in the seal;

locating the receptacle within the aperture and the mouth of the inner mount such that the seal is sandwiched between the upper face of the wall and the peripheral flange of the plug;

placing the cap over the peripheral flange, and securing the cap to the inner mount using a plurality of threaded fasteners that each extend through a respective one of said first, second and third mounting apertures.

Preferably the second jaw of the inner mount is provided with gripping means, such as a flange that depends from said second jaw, and whereby in use, a user may engage the gripping means, such as with their finger, so as to urge the second jaw generally towards the first jaw.

Preferably the fitting includes first alignment means associated with the inner mount and the plug for ensuring that the first and second mounting apertures are aligned when the receptacle is located in the mouth of the inner mount. Accordingly, when locating the receptacle within the mouth, it is preferred that the user uses the first alignment means to align the first mounting apertures with the second mounting apertures.

Preferably the fitting also includes second alignment means associated with the plug and the cap for ensuring that the second mounting apertures and the third mounting apertures are aligned when the peripheral flange is located within the cap's recess. Accordingly, when placing the cap over the peripheral flange, it is preferred that the user will use the second alignment means to align the second mounting apertures with the third mounting apertures.

In still yet another aspect, this invention relates to a combination of a fitting for creating a recess in a wall of a hull of a watercraft, said wall having an inner face and an outer face and an aperture formed in said wall, said aperture being surrounded by a peripheral edge portion and a structural member for a removable seat for said watercraft, said combination including:

a fitting having an inner mount that is locatable within the hull such that at least a portion thereof may abut against the inner face of the wall, said inner mount having two opposed jaws that are interconnected by an intermediate portion and a mouth located between said jaws, said inner mount being provided with a first set of mounting apertures, said inner mount also being provided with locating means for initially locating said inner mount on the peripheral edge portion and retaining means for retaining said inner mount in an operative position on the peripheral edge portion;

a seal made from a deformable material, said seal being generally plate like and having an opening formed therein;

a plug that includes an open topped receptacle having an opening, and a peripheral flange surrounding said opening, said flange being provided with a second set of mounting apertures that may be aligned with the first set of mounting apertures and wherein said receptacle is locatable within said mouth of said inner mount, and a cap having a top wall and a skirt depending from said top wall which in combination form a recess that is adapted to receive said peripheral flange of said plug and at least a portion of said seal, said cap further including an access opening formed in said top wall that in use shall provide access to said receptacle, and a third set of mounting apertures that may be aligned with said first and said second mounting apertures and a structural having a body that includes a first engagement portion that is adapted to engage a backrest of a removable seat and a second engagement portion that extends through said access opening and is located within said receptacle.

In order that this invention may be more readily understood and put into practical effect, reference will now be made to the accompanying drawings which illustrate a preferred embodiment of the invention wherein.

Figure 1:
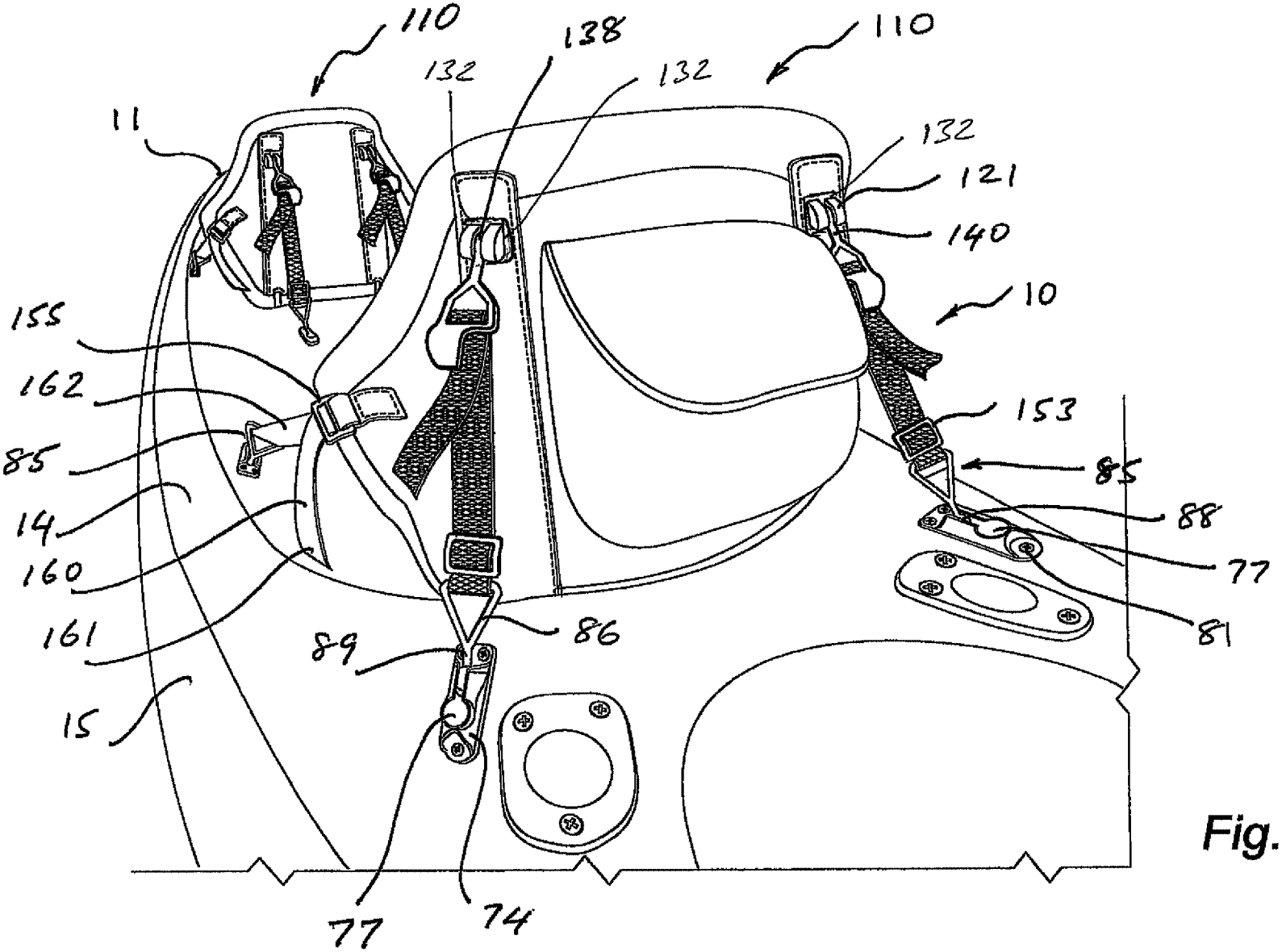
FIG. 1 is a pictorial rear view of a two man sit on top kayak that includes two removable seats that have each been constructed in accordance with the present invention
Figure 2:
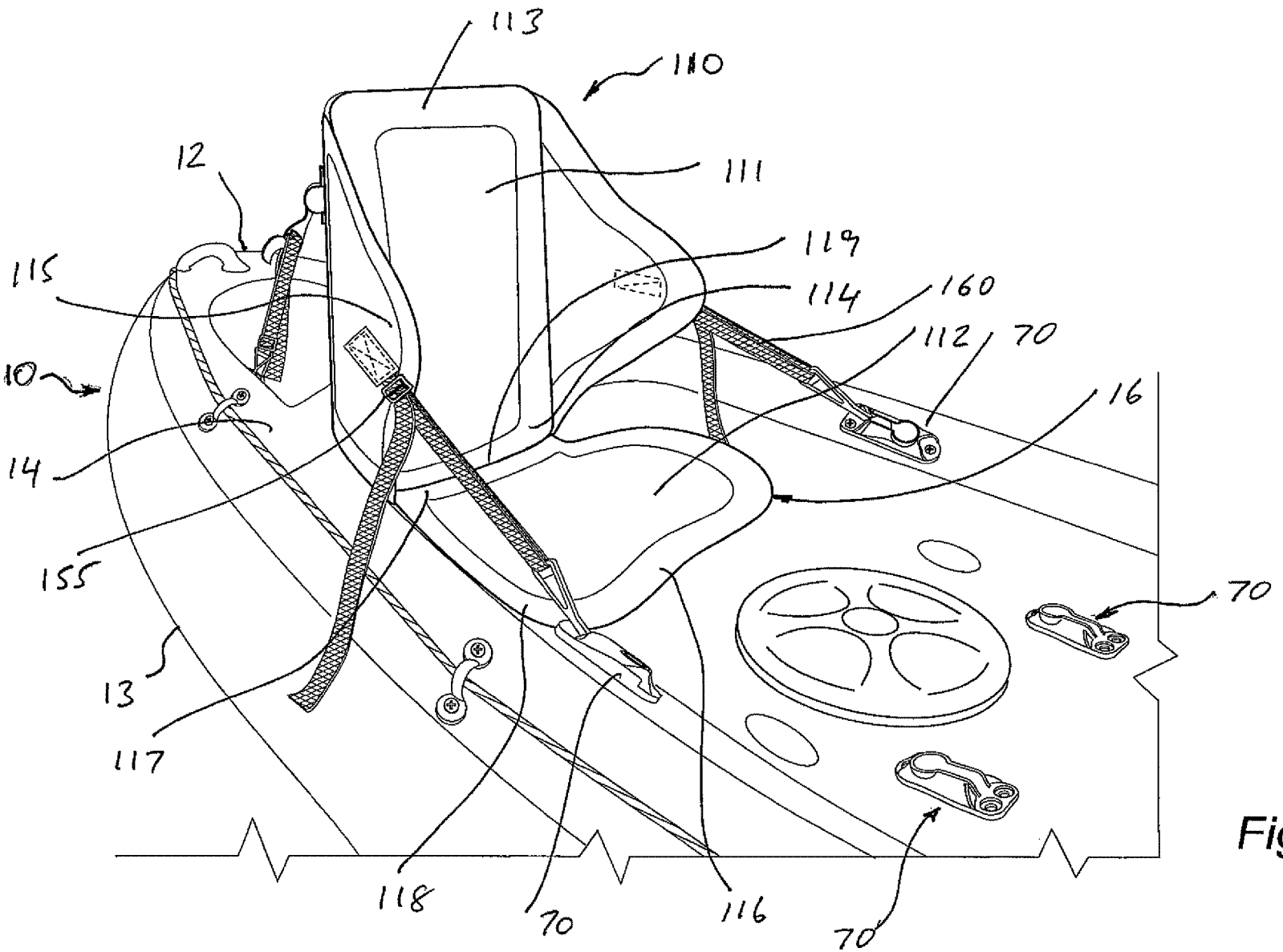
FIG. 2 is a pictorial side view of the sit on top kayak and the rear removable seat shown in FIG. 1.
Figure 3:
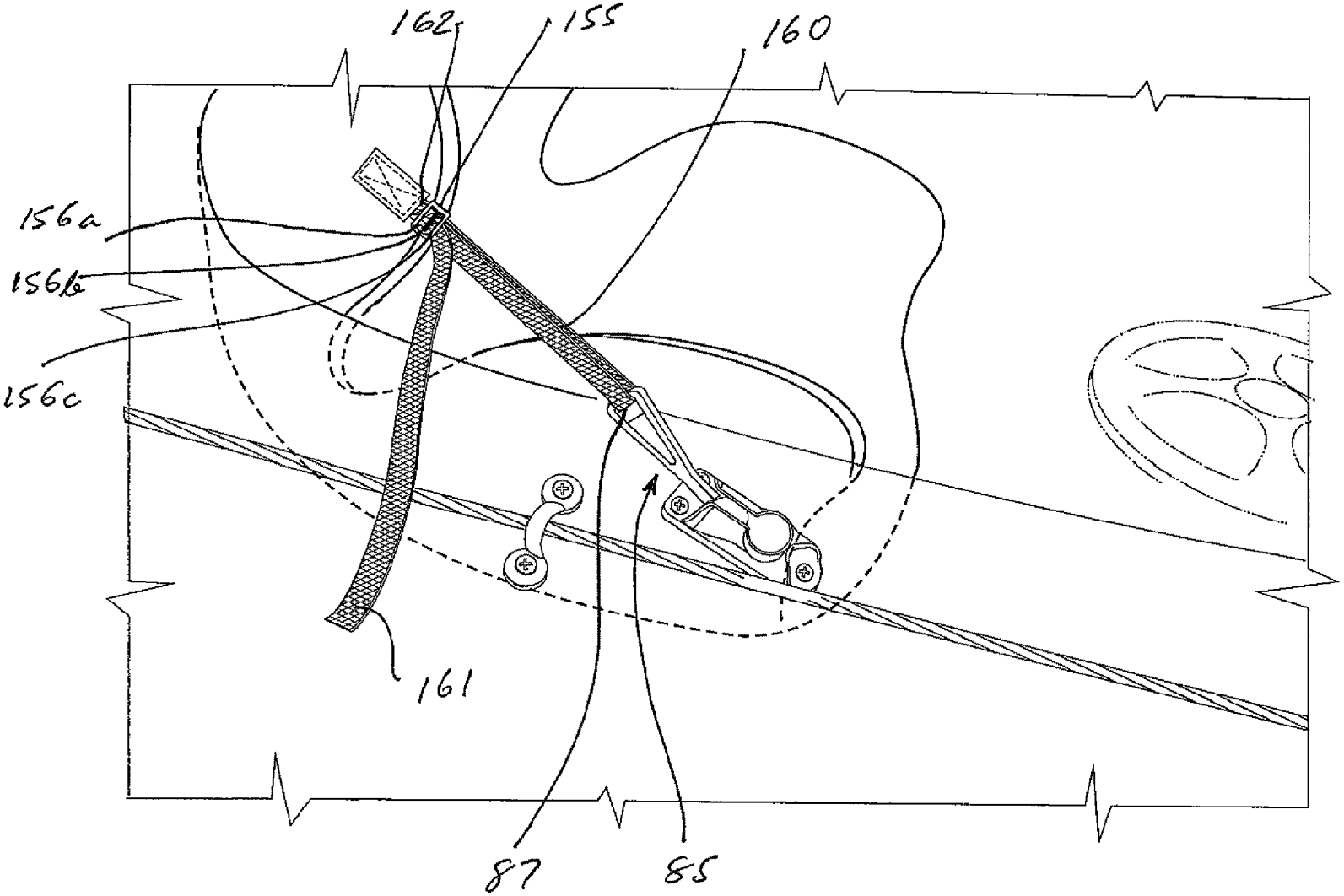
FIG. 3 is a pictorial side view of the seat shown in FIG. 2.
Figure 4:
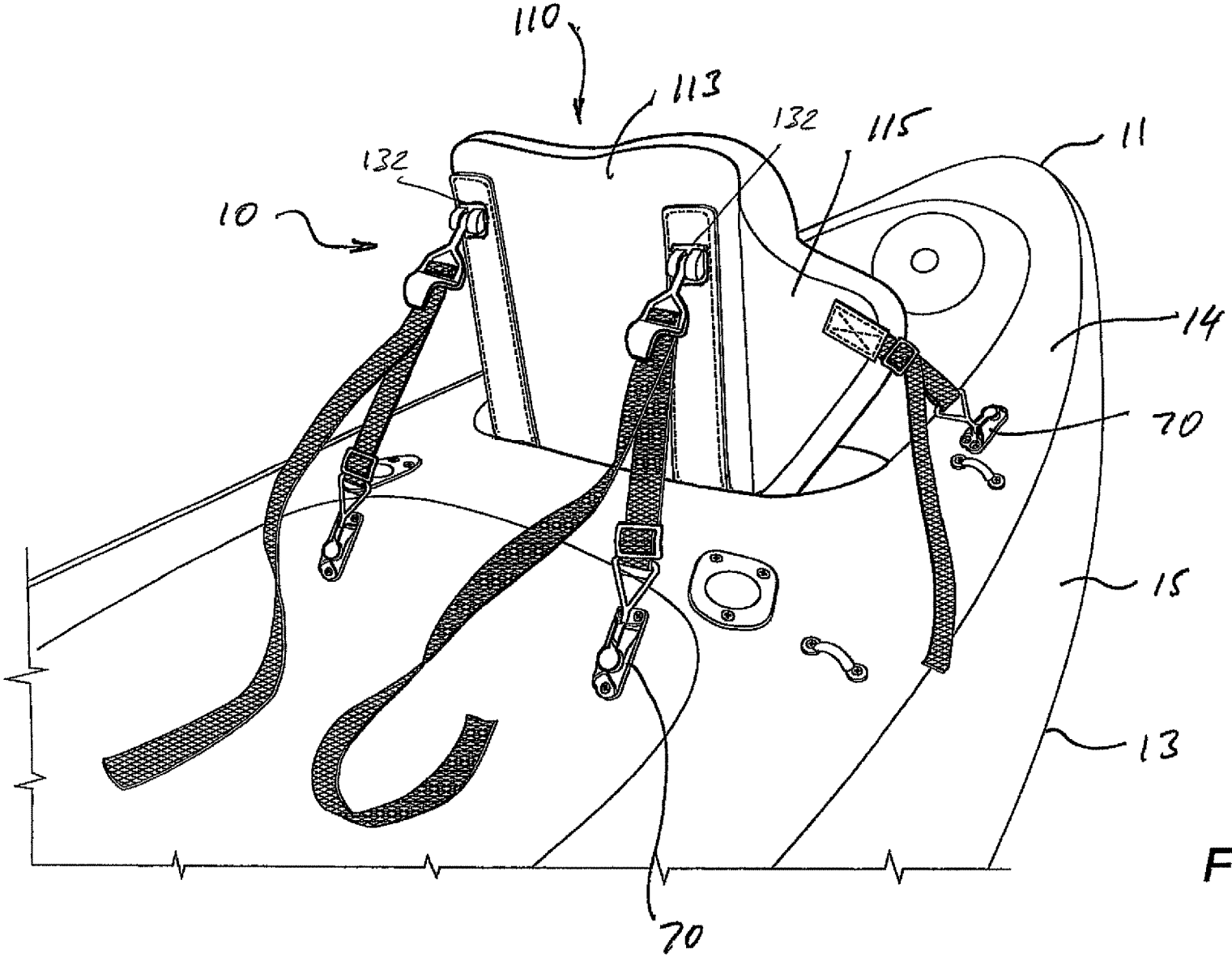
FIG. 4 is a pictorial rear view of the sit on top kayak and the front seat shown in FIG. 1.
Figure 5:
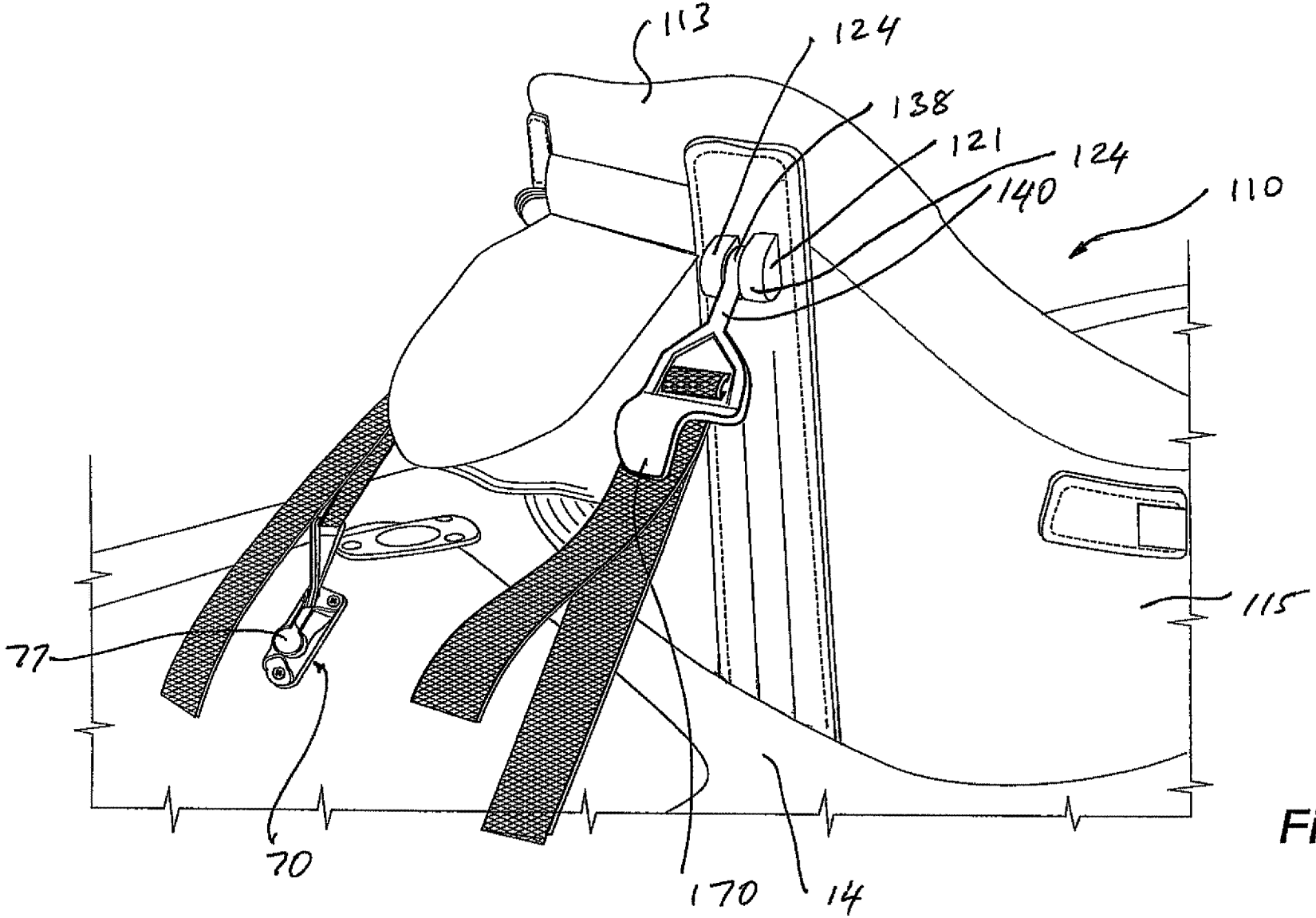
FIG. 5 is a pictorial rear view of the front seat shown in FIG. 4.
Figure 6:
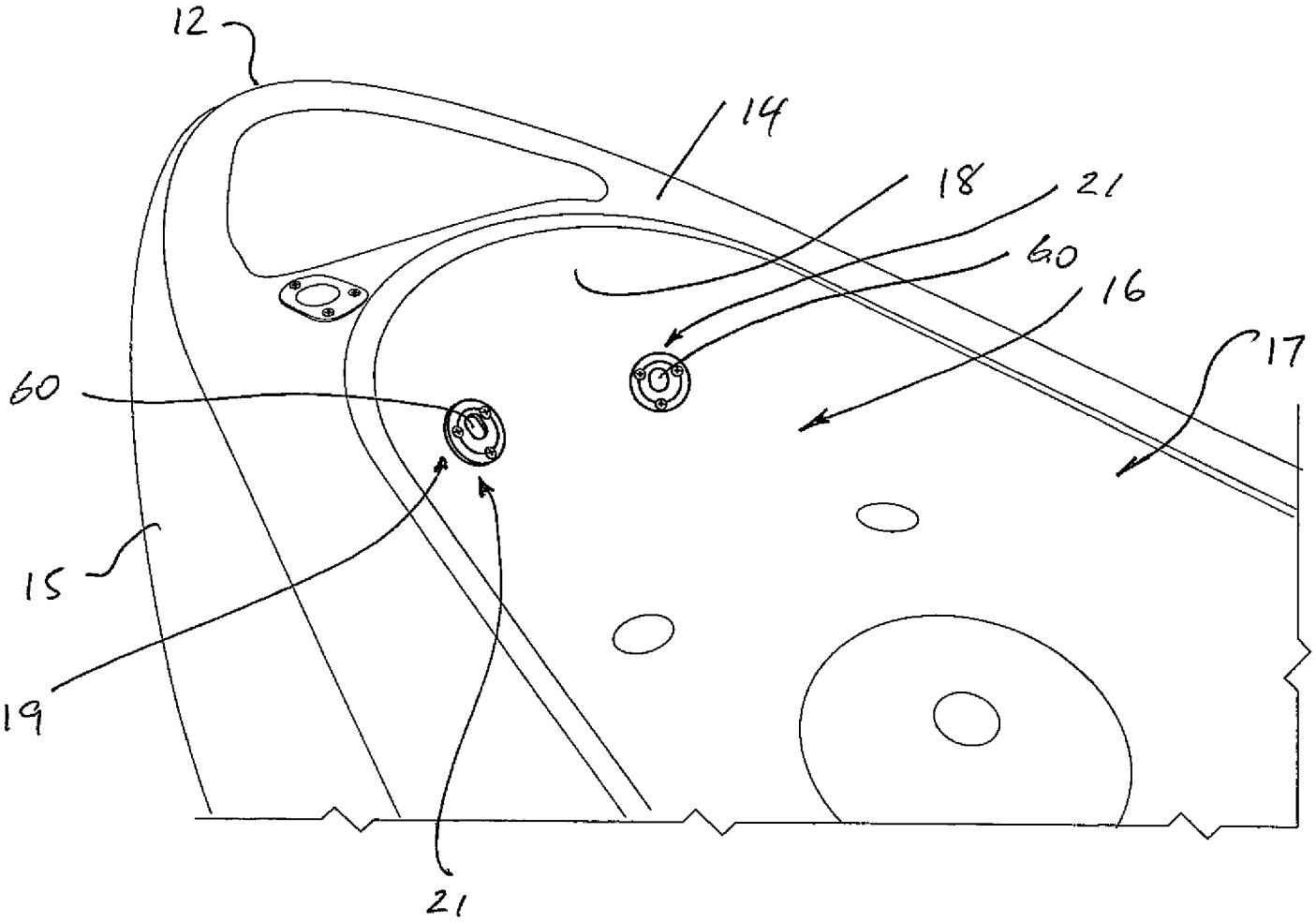
FIG. 6 is a pictorial front view of the sit on top kayak and, in particular, a rear seat portion formed in the kayak's deck and retaining means that have been constructed in accordance with the present invention.
Figure 7:
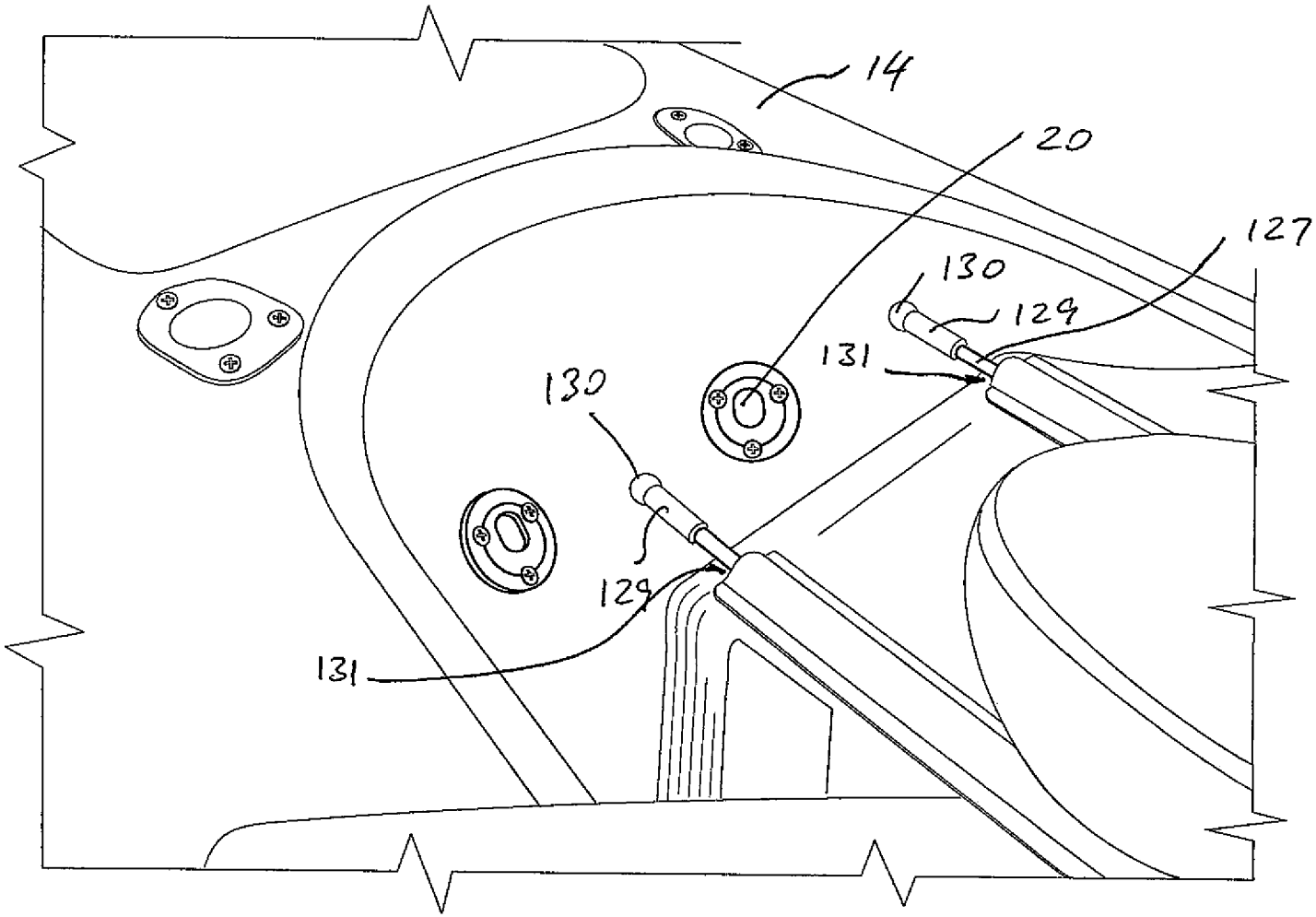
FIG. 7 is a pictorial top view of the seat portion shown in FIG. 6 and a removable kayak seat prior to it being operably mounted on the kayak.
Figure 8:
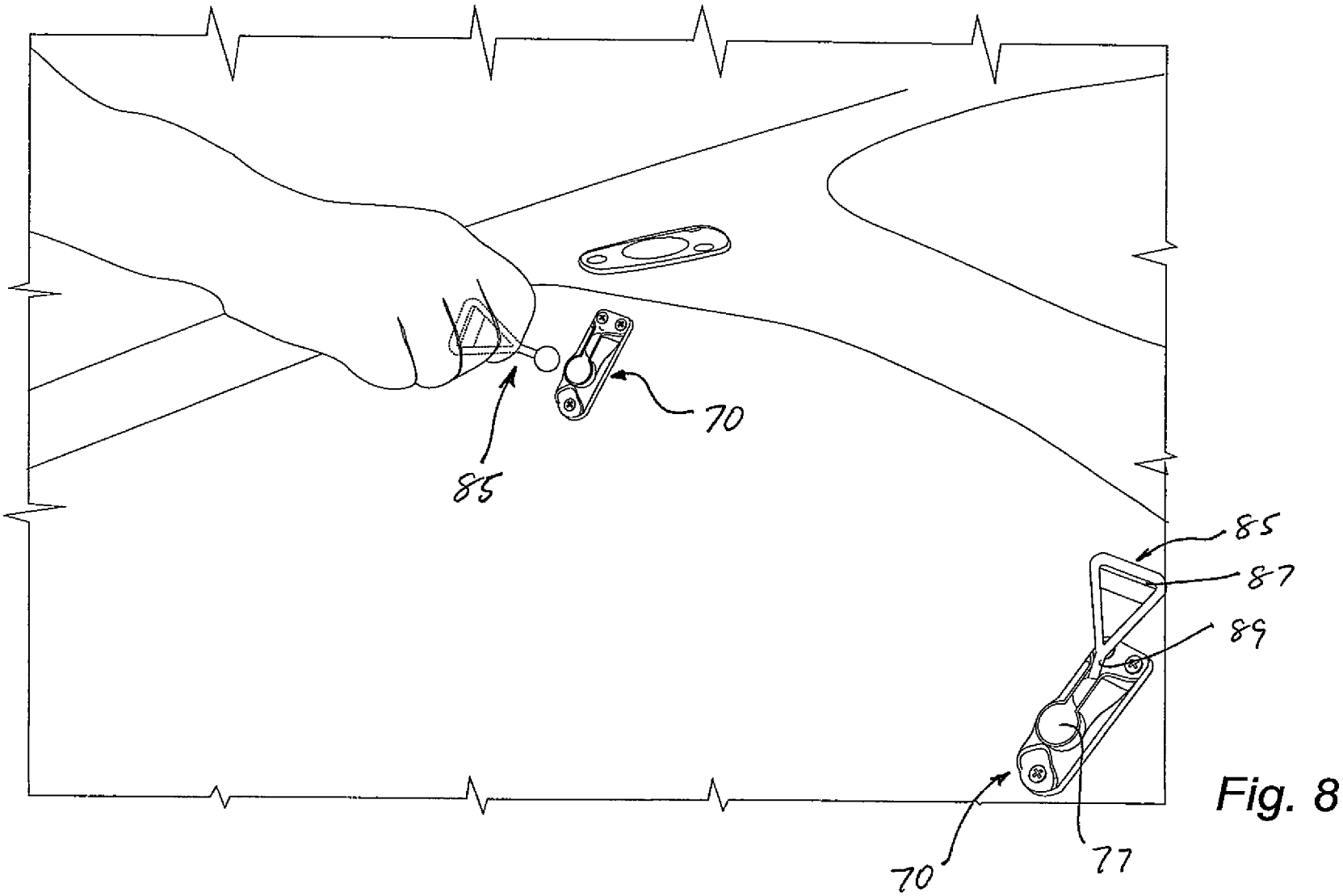
FIG. 8 is a pictorial rear view of the sit on top kayak and, in particular the rear seat portion and connecting means constructed in accordance with the present invention for connecting the seat to the deck.

FIGS. 1 to 9 show selected portions of a typical two man sit on top kayak 10 having a bow 11 and a stern 12, a hull or underside 13, and a deck 14 or top side, and wherein the deck 14 is connected to the hull 13 by opposing side rails 15. The deck 14 includes two seat portions 16 on which a respective paddler may sit and whereby each seat portion is itself located within a recess or cockpit 17 located partway between the bow 11 and stern 12 of the kayak 10.

The cockpit 17 includes an inclined, arcuate, rear wall 18 connecting the deck 14 to the seat portion 16 that may, in use, provide support for a paddler's lower back.

The kayak 10 also includes retaining means 19 in the form of two recesses 20 that have been created in the rear wall 18 after manufacture of the kayak hull. However, it will be appreciated that suitable recesses could have been created in the rear wall 18 during the prosses of manufacturing the hull. For example, if a mould is used to make the hull, a plug or protrusion in the mould may be used to create the recess.

FIGS. 40 to 42 and 55 to 57 in particular, show two alternative fittings 21 and 201 for creating a recess in a wall of the kayak 10.

The fitting 21 includes an inner mount 22, a seal 23, a plug 24 and a cap 25.

The inner mount 22 is made from a resilient plastics material and includes a body 26 comprising a broad band, in the form of discontinuous ring, having opposed free end portions 27 that are interconnected by an arcuate intermediate portion 28, as well as a broad top face 29 and an opposing bottom face 30.

The inner mount 22 also includes mounting means 31 for securing the inner mount 22 to the deck 16 of the kayak 10, including four mounting apertures 32, and mounting means 33 for securing the cap 25 to the inner mount 22, including three mounting apertures 34.

The body 26 is symmetrical about a line of symmetry that bisects the intermediate portion 28 and a gap between opposing end portions 27. Two of the mounting apertures 32 are each formed in a respective one of the end portions 27, while the other two mounting apertures 32 are formed in the intermediate portion 28 and are located on either side of the axis of symmetry.

Two of the mounting apertures 34 are each formed in a respective one of the end portions 27, and adjacent a mounting aperture 32, while the third mounting aperture 34 is formed in the intermediate portion 28 such that its centre lies on the axis of symmetry and midway between adjacent mounting apertures 32.

The body 26 further includes four short screw bosses 35 that each depend from the bottom face 30 and whereby each includes a passageway that is aligned with one of the mounting apertures 32.

The body 26 also includes three long screw bosses 36 that each depend from the bottom face 30 and whereby each includes a passageway that is aligned with one of the mounting apertures 34.

The body 26 includes an inner peripheral edge portion 37 that defines a substantially circular shaped opening or socket 38 and wherein a small protrusion 39, having a rounded profile, extends inwardly from the edge portion 37, said protrusion 39 having an axis of symmetry that is aligned with the axis of symmetry of the inner mount 22.

The seal 23 is made from a deformable material, such as a rubber material, including neoprene. The seal 23 is reasonably thick and plate like and has a generally circular outer profile 40 and a centrally located, circular shaped, aperture 41.

The plug 24 includes a receptacle 42 having a bottom 43, that has a generally flat internal bottom face 44, and an upper peripheral edge portion 45, that defines a generally circular shaped opening 46, and a continuous peripheral flange 47 that extends generally outwardly from the peripheral edge portion 45 and generally parallel to the bottom face 44.

The receptacle 42 includes a continuous side wall 48 that connects the bottom 43 and the peripheral flange 47, the bottom 43, side wall 48 and flange 47 being contiguous.

The side wall 48 includes a substantially cylindrically shaped upper portion **48*a* having a continuous outer face 48*b*, and a lower transition portion 48*c* that is curved both internally and externally, when viewed in cross-section by a cutting plane that is perpendicular to the flange 47. The transition portion 48*c* has a curved inner face 49 and a curved outer face 50**.

The side wall 48 also includes a channel 51 formed in the outer faces **48*b* and 50 that has a lower end that is open, and which is located near the bottom 43, and an upper end that is closed by the peripheral flange 47, such that the channel 51 is generally perpendicular to the peripheral flange 47. The channel 51 is bounded on opposite sides by opposing side walls 52, and wherein the lower end portions 53 of these side walls may, in use, help guide the protrusion 39** into the channel.

The peripheral flange 47 includes four openings 54 that are aligned with a respective one of the mounting apertures 32 when the receptacle 42 is located in the socket 38 and the protrusion 39 is located within the channel 51.

The peripheral flange 47 also includes three openings 55 that are aligned with a respective one of the mounting apertures 34 when the receptacle 42 is located in the socket 38 and the protrusion 39 is located within the channel 51.

The cap 25 includes a substantially circular shaped top wall 56 having a peripheral edge portion 57 and a continuous skirt or flange 58 that depends from the peripheral edge portion, said top wall 56 in combination with said flange 58 defining a recess or cavity 59 that is adapted to receive the peripheral flange 47 of the plug 24 and the seal 23.

The top wall 56 also includes a generally oval shaped opening 60 having a major axis and a minor axis and whereby the centre of the oval shaped opening 60, where the two axes intersect, is offset from the axis of the receptacle 42, such that a vertex **60*a* of the oval opening 60 is substantially flush with the internal face 48*d* of the upper portion 48*a*** of the receptacle.

The top wall 56 also includes three mounting apertures 61 that are spaced equally around the periphery of the top wall and which, in use, each may be aligned with a respective one of openings 55 and the mounting apertures 34.

In use, a retaining recess 20 may be created by firstly drilling a hole 62 in the seat portion that is large enough to receive the receptacle 42, the hole 62 having a generally circular peripheral edge portion 63.

Next, the receptacle 42 is temporarily located in the hole 62 such that the peripheral flange 47 rests on the seat portion 16 surrounding the hole 62. By holding the peripheral flange 47 still such that it does not move relative to the seat portion 16, the user may use the openings 54 and 55 as a template for drilling corresponding openings 64 and 65 respectively into the seat portion of the kayak.

In order to locate the inner mount 22 on the inside of the kayak, it is first necessary to position the edge 63 between the end portions 27, such that one end portion **27*a* is contained within the hole 62 and to then rotate the inner mount 22 in the general direction of the end portion 27*a* such that it passes beneath the seat portion 16 till the entirety of the inner mount 22** is contained within the kayak.

The user, using one or more fingers from one of his or her hands, may retain the inner mount 22 in a preferred operative position whereby the top face 29 abuts against an internal face 66 of the seat portion 16 and the mounting apertures 32 are each aligned with a respective one of the openings 64.

The inner mount 22 is then retained in this operative position by four screws 200 each having a threaded stem or shaft that extends through a respective opening 64 and an aligned aperture 32.

Next, the receptacle 42 of the plug 24 is inserted into the aperture 41 of the seal 23. The receptacle 42 is then inserted into the hole 62 such that the seal is located between the underside of the flange 47 and the seat portion 16, and wherein a lower portion of the receptacle 42 extends into the socket 38. The plug 24 is then rotated relative to the inner mount 22 until the protrusion 39 is located within the channel 51. This then ensures that the apertures 55 are each aligned with a respective one of apertures 65 and apertures 34.

The cap 25 is then placed over the plug 24 and rotated relative to the plug until apertures 61 are each aligned with a respective one of the apertures 55.

Three screws 67 are then used to secure the cap 25 to the inner mount 22, each screw having a threaded stem that extends through aligned apertures 61, 55, 65 and 34. Further, as the screws are tightened, the seal, which is mostly housed within the cap forms a water tight seal between the flange 47 and the seat portion 16, said seal conforming to the arcuate shape of the seat portion.

The fitting 201 includes an inner mount 202, a seal 203, a plug 204 and a cap 205.

The inner mount 202 is made from a resilient plastics material and includes a body 206 comprising a broad band, in the form of discontinuous ring, having opposed free end portions 207 that are interconnected by an arcuate intermediate portion 208, as well as a broad top face 209 and an opposing bottom face 210.

The opposed free end portions 207, or jaws, in combination with the intermediate portion 208 define a generally circular shaped mouth or socket 211 having an inner peripheral edge portion 212 and wherein the inner mount 202 also has an opposing outer peripheral edge portion 213.

The inner mount 202 also includes location means 214 for temporarily locating the inner mount 202 on the peripheral edge portion 63 of the hole 62, including a first hook like protrusion 215, that extends upwardly from the top face 209 of end portion 207*a*, and a second hook like protrusion 216 that extends upwardly from the top face 209 of the intermediate portion 208.

Each hook like protrusion 215 and 216 includes a head portion 217 that is connected to the top face 209, of the inner peripheral edge portion 212, by a stem 218 and wherein the head portion 217 includes a lip 219 that extends outwardly away from the stem 218 in the general direction of the outer peripheral edge portion 213 of the inner mount 202.

The inner mount 202 also includes a set of three mounting apertures 220 that are each aligned with a passageway in respective boss 221 that depends from the bottom face 210.

The inner mount 202 also includes retaining means 222 for retaining the inner mount in an operative position on the peripheral edge portion 63 of the hole 62, including a third hook like protrusion 223 that extends upwardly from the top face 209 of the end portion 207*b*. The hook like protrusion 223 includes a head portion 224 that is connected to the top face 209, of the inner peripheral edge portion 212, by a stem 225 and wherein the head portion 224 includes a lip 226 that extends outwardly away from the stem 225 in the general direction of the outer peripheral edge portion 213 of the inner mount 202.

The inner mount 202 also includes gripping means 227, in the form of an arcuate flange 228 that depends from the bottom face 210, adjacent the outer peripheral edge portion 213 and the hook like projection 223.

The lower end portions 229 and 230 of the two stems 218, and the lower end portion 231 of the stem 225, each have a generally rounded profile that extends inwardly from the inner peripheral edge portion 212.

The seal 203 is made from a deformable material, such as a rubber material, including neoprene. The seal 203 is reasonably thick and plate like and has a generally circular outer profile 232 and a centrally located, circular shaped, aperture 233.

The plug 204 includes a receptacle 234 having a bottom wall 235, that has a generally flat internal bottom face 236, and an upper peripheral edge portion 237, that defines a generally circular shaped opening 238, and a continuous peripheral flange 239 that extends generally outwardly from the peripheral edge portion 237 and generally parallel to the bottom face 236.

The receptacle 234 includes a continuous side wall 240 that connects the bottom wall 235 and the peripheral flange 239, the bottom wall 235, side wall 240 and flange 239 being contiguous.

The side wall 240 includes a substantially cylindrically shaped upper portion 241 having a continuous outer face 242, and a lower transition portion 243 that is curved both internally and externally, when viewed in cross-section by a cutting plane that is perpendicular to the flange 239. The transition portion 243 has a curved inner face 244 and a curved outer face 245.

The side wall 240 also includes three channels 246 that are each formed in the outer faces 242 and 245 and wherein each includes a lower end that is open, and which is located near the bottom wall 235, and an upper end that is closed by the peripheral flange 239, such that each channel 246 is generally perpendicular to the peripheral flange 239. Each channel 246 is bounded on opposite sides by opposing side walls 247, and wherein the lower end portions 248 of these side walls may, in use, help guide a head portion of a respective hook like protrusion 215, 216 or 223 into the channel 246.

The peripheral flange 239 includes three openings or apertures 249 that are aligned with a respective one of the mounting apertures 220 when the receptacle 234 is located in the socket 211 and the protrusions 215, 216 and 223 are each located within a respective channel 246. Further, to ensure that the cap 205 is correctly aligned with the inner mount 202, the channel or groove 246*a* is off centre, that is to say, it is angularly spaced from channel 246*b* more than it is angularly spaced from channel 246*c*. Consequently, there is only one orientation of the plug 204 that will mate with the inner mount 202.

The peripheral flange 239 also includes a notch 250 formed in an edge portion thereof and wherein the notch 250 is aligned with the aperture 249*a*.

The cap 205 includes a substantially circular shaped top wall 251 having a peripheral edge portion 252 and a continuous skirt or flange 253 that depends from the peripheral edge portion, said top wall 251 in combination with said flange 253 defining a recess or cavity 254 that is adapted to receive the peripheral flange 239 of the plug 204 and the seal 203.

The top wall 251 also includes a generally oval shaped opening 255 having a major axis and a minor axis and whereby the centre of the oval shaped opening 255, where the two axes intersect, is offset from the axis of the receptacle 234, such that a vertex 256 of the oval opening 255 is substantially flush with the internal face 257 of the upper portion 241 of the receptacle, and wherein the opening 255 has two substantially straight sides 258.

The top wall 251 also includes three mounting apertures 259 that are spaced equally around the periphery of the top wall and which, in use, each may be aligned with a respective one of openings 249 and the mounting apertures 220.

The cap 205 also includes a small flange or catch 268 that depends from the underside of the top wall 251 and which extends inwardly from the flange 253 in a radial direction. The catch 268 is adapted to be received within the notch 250.

In use, a retaining recess 20 may be created in a wall of a hull of a watercraft, such as a kayak, by firstly drilling a hole 62 in the seat portion that is large enough to receive the receptacle 234, the hole 62 having a generally circular peripheral edge portion 63.

Where the fitting 201 is intended to be used as a mount for a removable kayak seat of the type described in this specification, the user may be provided with a template 260 to aid the user to correctly position the hole 62 on the hull. The removable seat, when assembled, may be secured to or removed from an assembled watercraft that is otherwise for use.

The template 260 may be a rectangular shaped piece of paper on which is drawn a centre line 261 that corresponds to an axis of symmetry.

The user may firstly string a line 262 along the centre of the kayak and using a level, position the kayak such that it is level in both a longitudinal and a transverse direction.

Then using a plumb bob suspended from the string line 262, align the centre line 261 of the template 260 with the string line 262.

The template 260 is then slid along the centre line until it is a predetermined distance, (40 mm in this embodiment), from a predetermined reference point, (in this case the scupper holes 264). The corners 263 of the template 260 coincide with the centre of the holes 62.

Before removing the template, the user should also draw two reference lines 265 on the kayak using the side edges 266 of the template.

Next, the receptacle 234 is temporarily located in the hole 62 such that the peripheral flange 239 rests on the seat portion 16 surrounding the hole 62 and the notch 250 points towards the bow. The plug 204 is then rotated clockwise within the hole 62 until a side of the aperture 249*a* aligns with reference line 265.

The user shall then using a drill, drill a hole 267 in the wall of the kayak using the aperture 249*a* as a guide and whereby a screw extending through the aperture 249*a* and the newly drilled hole may be used to temporarily secure the plug 204 to the kayak wall.

The drill may then be used to drill two more holes 268 and 269 in the wall of the kayak After removing the plug 204 from the hole 62, the user may then locate the inner mount 202 on the inside of the kayak. This is achieved by first positioning the peripheral edge portion 63 between the end portions 207, such that one end portion 207*b* is contained within the hole 62, while holding end portion 207*a* between the user's index finger and thumb, which are positioned between hook like protrusions 215 and 216. The user may then rotate the inner mount 202 in the general direction of the end portion 207*b* such that it passes beneath the wall until the entirety of the inner mount 22 is contained within the kayak.

The user, may then use his or her index finger to pull against the end portion 207*a* until the peripheral edge portion 63 of the hole 62 is located between the lips 219 of the two protrusions 215 and 216 and the top face of the end portion 207*a*. In this position the head portion 224, of the protrusion 223 is pushing up against the underside of the wall and whereby the inner mount 202 is held firmly in this temporary position by the resilient nature of the inner mount.

The user may then, using his or her index finger, grip the flange 228 so as to pull the end portion 207*b* generally towards end portion 207*a*. While doing so, the head portion 224, of the protrusion 223, will pop up, once clear of the peripheral edge portion 63, of the hole 62, due to the resilient nature of the inner mount 202, and, upon releasing the flange 228, the protrusion 223 shall engage the peripheral edge portion 63. That is to say, the peripheral edge portion 63 will be positioned between the lip 226 and the top face of the end portion 207*b*.

The inner mount 202, when in this operative position, is free to rotate relative to the peripheral edge portion 63.

Next, the receptacle 234 of the plug 204 is inserted into the aperture 233 of the seal 203. The receptacle 234 is then inserted into the hole 62 such that the seal is located between the underside of the flange 239 and the wall, and wherein a lower portion of the receptacle 234 extends into the mouth or socket 211. The plug 204 is then rotated relative to the inner mount 202 until each of the protrusions 215, 216 and 223 are located within a respective groove or channel 246. This then ensures that the apertures 249 and the mounting apertures 220 are aligned.

The cap 205 is then placed over the plug 204 and rotated relative to the plug until the catch 268 locates within the notch 250. In this position, the mounting apertures 259 are aligned with a respective one of openings 249 and the mounting apertures 220.

The whole assembled fitting 201 is now free to rotate relative to the wall and wherein a preferred orientation of the fitting will be achieved by aligning a side of the mounting aperture 259*a* with the reference line 265, just as the mounting aperture 249*a* was previously aligned with reference line 265.

Three screws 270 are then used to secure the cap 205 to the inner mount 202, each screw having a threaded stem that extends through aligned apertures 259, 249, 220 with a respective one of holes 267, 268 and 269 in the wall. Further, as the screws are tightened, the seal, which is mostly housed within the cap forms a water tight seal between the flange 239 and the seat portion 16, said seal conforming to the arcuate shape of the seat portion.

The kayak 10 further includes two female strap connectors or fittings 70 mounted on the deck 14, or a cockpit wall, generally in front of the seat portion 16, and another two fittings 70 mounted on the deck 14, or a cockpit wall, behind the seat portion 16.

Each fitting 70, shown in detail in FIGS. 23 to 26, includes a plate like, generally rectangular shaped, base 71 in which there is formed an elongate opening 72, having rounded end portions 73, that extends between opposing ends of the base.

The fitting 70 further includes two opposing side walls 74 that each extend upwardly from the base 71. Each side wall 74 includes an elongate free edge portion 75, and whereby the free edge portions 75 generally converge towards one another and partially define an elongate slot 76 having an enlarged, generally circular opening or mouth 77 located at one end and a much narrower opening 78 at the opposite end that is defined by opposing end portions 79 of the side walls 74. Further, the underside 80 of the side walls 74 is generally curved.

The base 71 of the fitting 70 is provided with three mounting apertures 81 through which respective threaded fasteners that are used to secure the fitting to the kayak may extend.

It will be appreciated that in other embodiments, a connector that is similar to the fitting 70 may be formed in the deck 14 during the moulding process whereby there may be an opening formed in the deck that is similar to mouth 77 and wherein the opening may cooperate with a slotted opening that is similar to slot 76. As a consequence, instead of the fitting 70 sitting proud of the deck 14 the connector may be generally flush with the deck.

Figure 27:
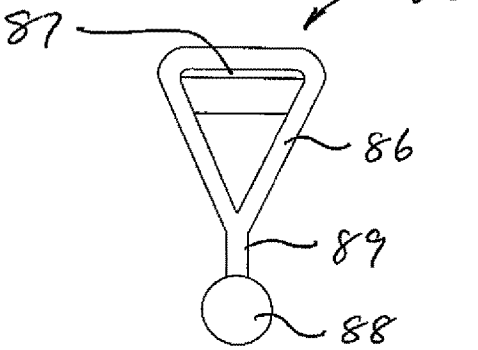
FIG. 27 is a front view of a male strap strap connector that has been constructed in accordance with the present invention.
Figures 28, 29, 30, 31, 32, 33, 34, 35, 36, 37, 38, 39:
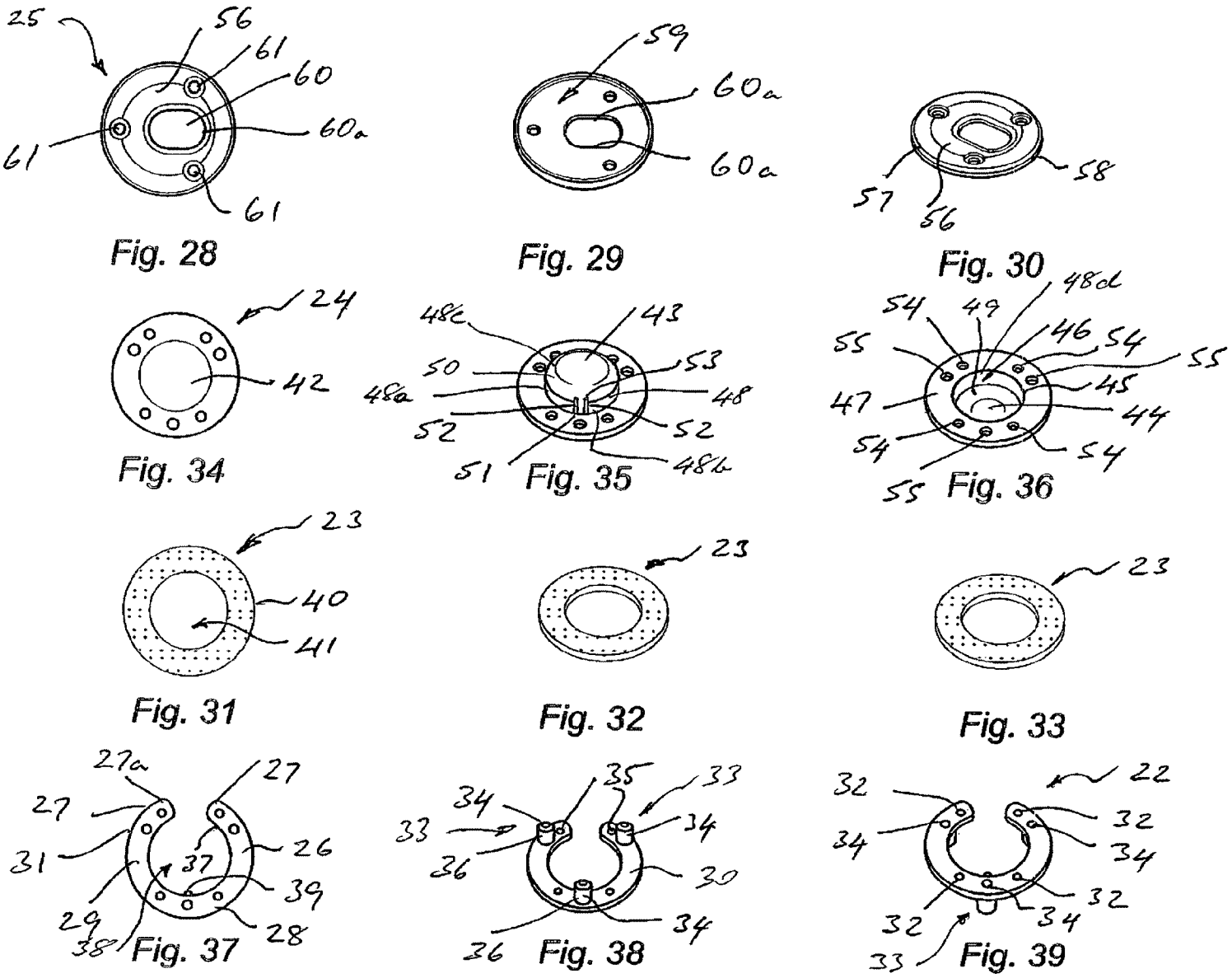
FIG. 28 is a top view of a cap of a fitting for creating a recess in a wall of a hull of a watercraft that has been constructed in accordance with the present invention.
FIG. 29 is a bottom view of the cap shown in FIG. 28.
FIG. 30 is a perspective top view of the cap shown in FIG. 28.
FIG. 31 is a top or bottom view of a seal of the fitting for creating a recess in a wall of a hull of a watercraft.
FIG. 32 is a perspective top view of the seal shown in FIG. 31.
FIG. 33 is a perspective bottom view of the seal shown in FIG. 31.
FIG. 34 is a top view of a plug of the fitting for creating a recess in a wall of a hull of a watercraft.
FIG. 35 is a perspective bottom view of the plug shown in FIG. 34.
FIG. 36 is a perspective top view of the plug shown in FIG. 34.
FIG. 37 is a top view of an inner mount of the fitting for creating a recess in a wall of a hull of a watercraft.
FIG. 38 is a bottom perspective view of the inner mount shown in FIG. 37.
FIG. 39 is a top view of the inner mount shown in FIG. 37.
Figure 40:
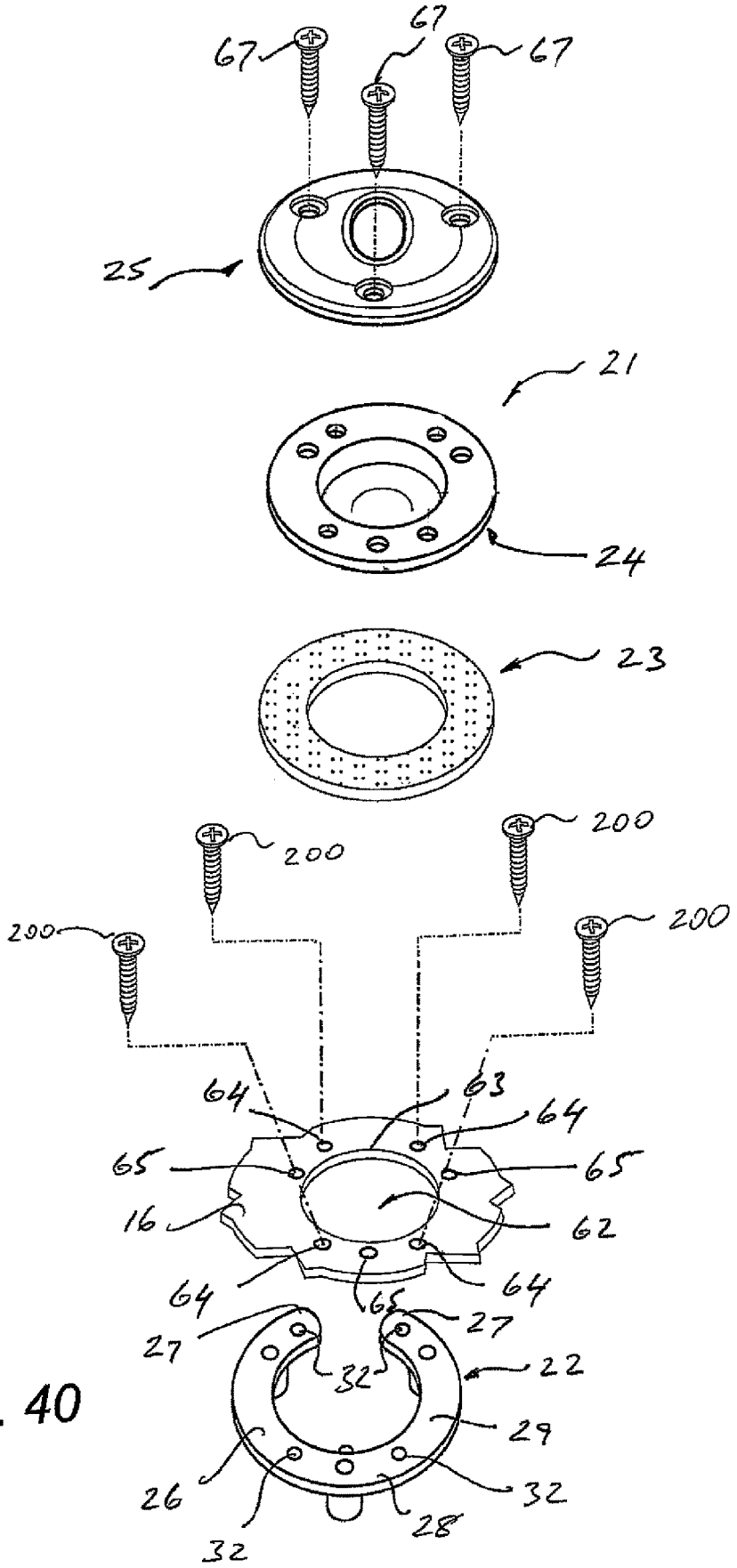
FIG. 40 is a perspective exploded view of the fitting for creating a recess in a wall of a hull of a watercraft.
Figure 41:
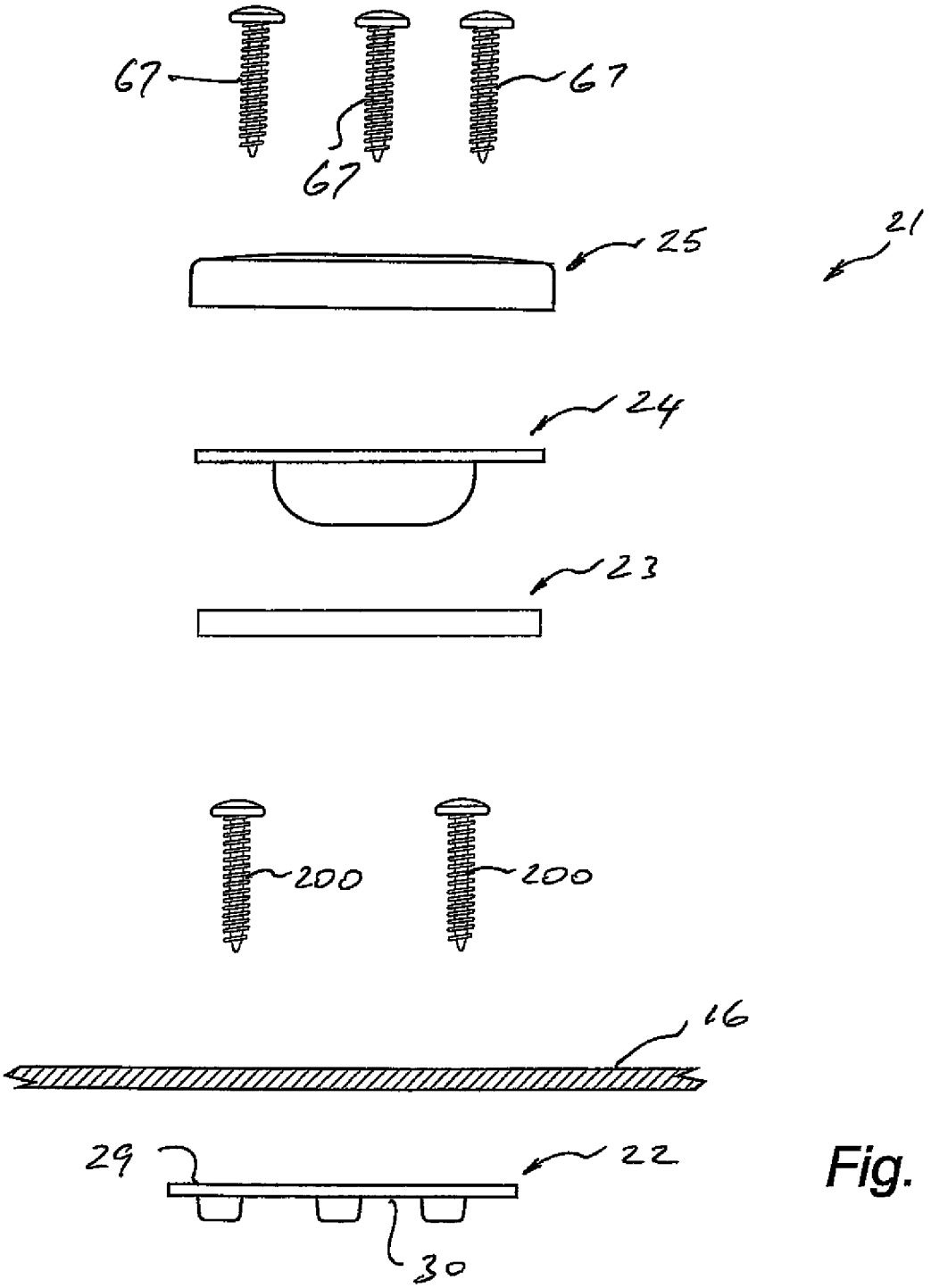
FIG. 41 is a side view of the fitting for creating a recess in a wall of a hull of a watercraft.
Figure 42:
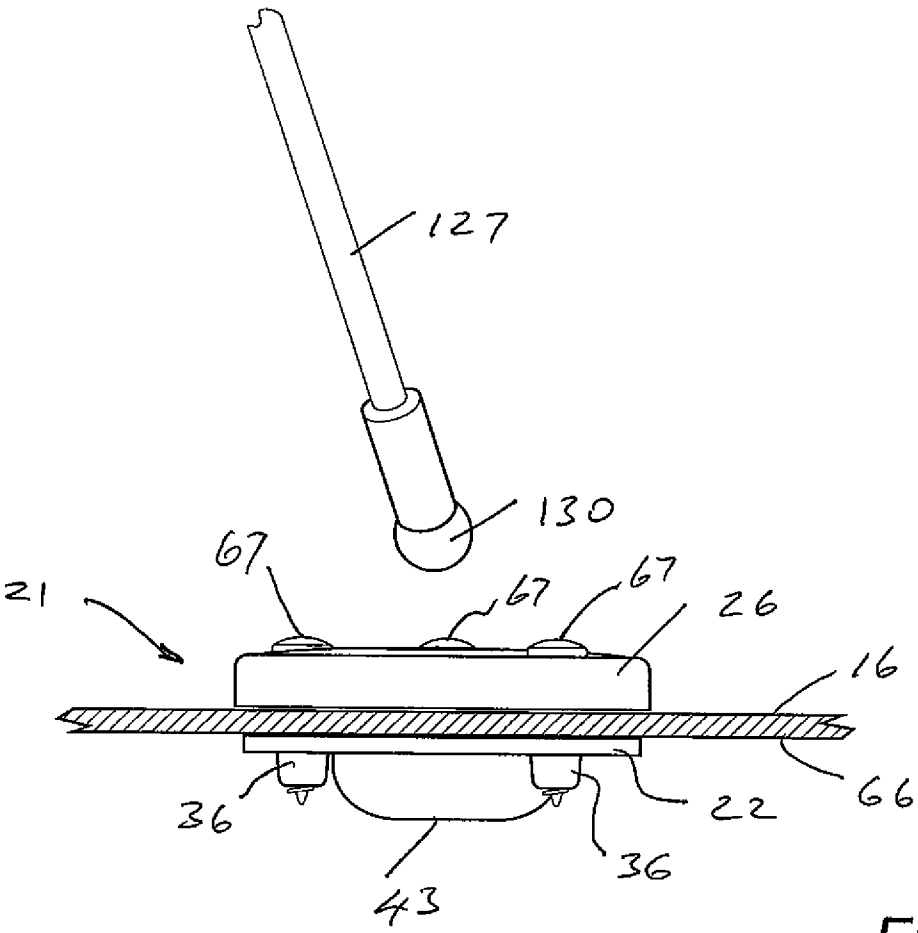
FIG. 42 is a side view of the fitting for creating a recess in a wall of a hull of a watercraft.
Figures 43, 44, 45, 46, 47, 48, 49, 50, 51, 52, 53, 54:
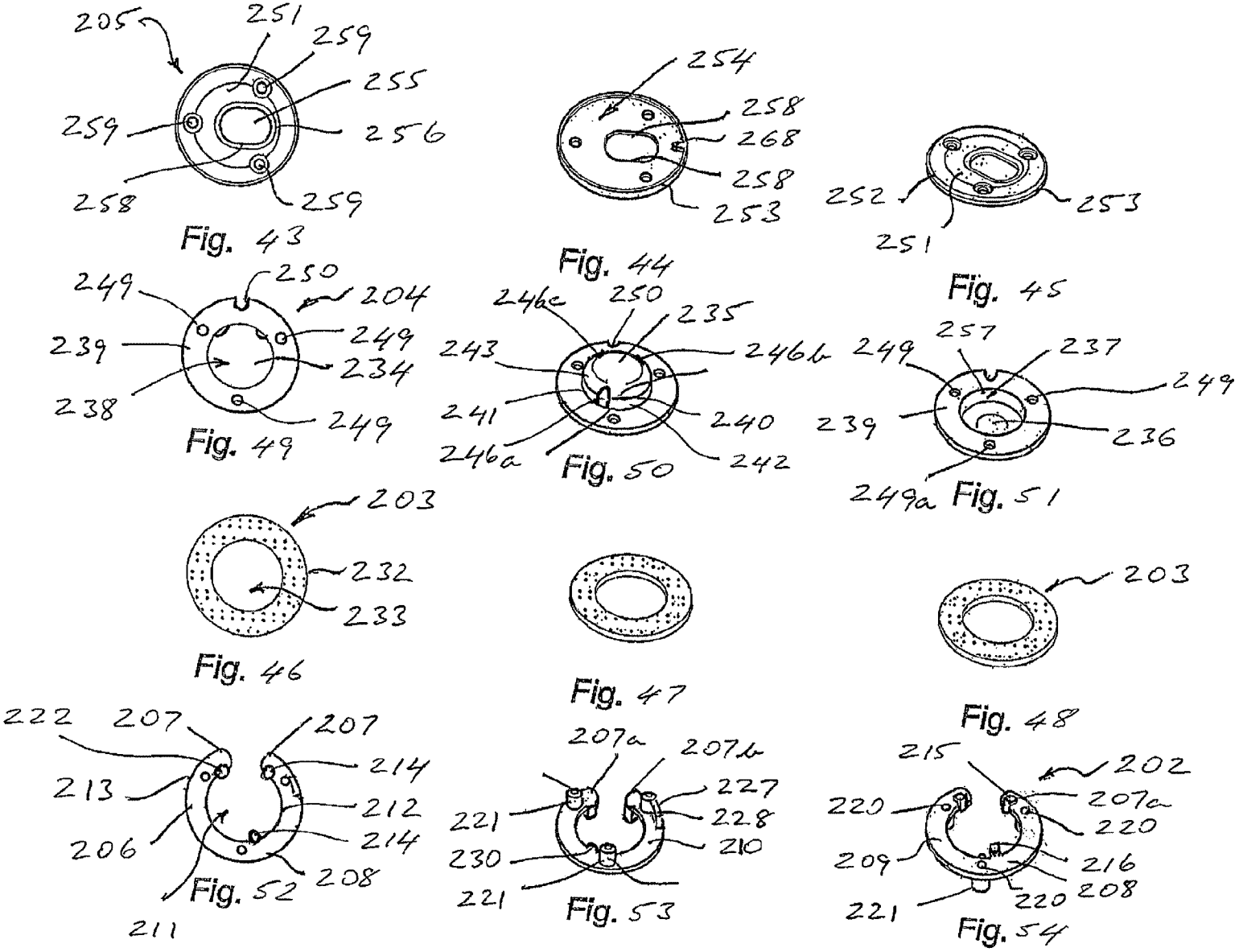
FIG. 43 is a top view of a cap of a second fitting for creating a recess in a wall of a hull of a watercraft seat recess assembly that has been constructed in accordance with the present invention.
FIG. 44 is a bottom view of the cap shown in FIG. 43.
FIG. 45 is a perspective top view of the cap shown in FIG. 43.
FIG. 46 is a top or bottom view of a seal of the second fitting for creating a recess in a wall of a hull of a watercraft.
FIG. 47 is a perspective top view of the seal shown in FIG. 46.
FIG. 48 is a perspective bottom view of the seal shown in FIG. 46.
FIG. 49 is a top view of a plug of the second fitting for creating a recess in a wall of a hull of a watercraft.
FIG. 50 is a perspective bottom view of the plug shown in FIG. 49.
FIG. 51 is a perspective top view of the plug shown in FIG. 49.
FIG. 52 is a top view of an inner mount of the second fitting for creating a recess in a wall of a hull of a watercraft.
FIG. 53 is a bottom perspective view of the inner mount shown in FIG. 52.
FIG. 54 is a top view of the inner mount shown in FIG. 52.
Figure 55:
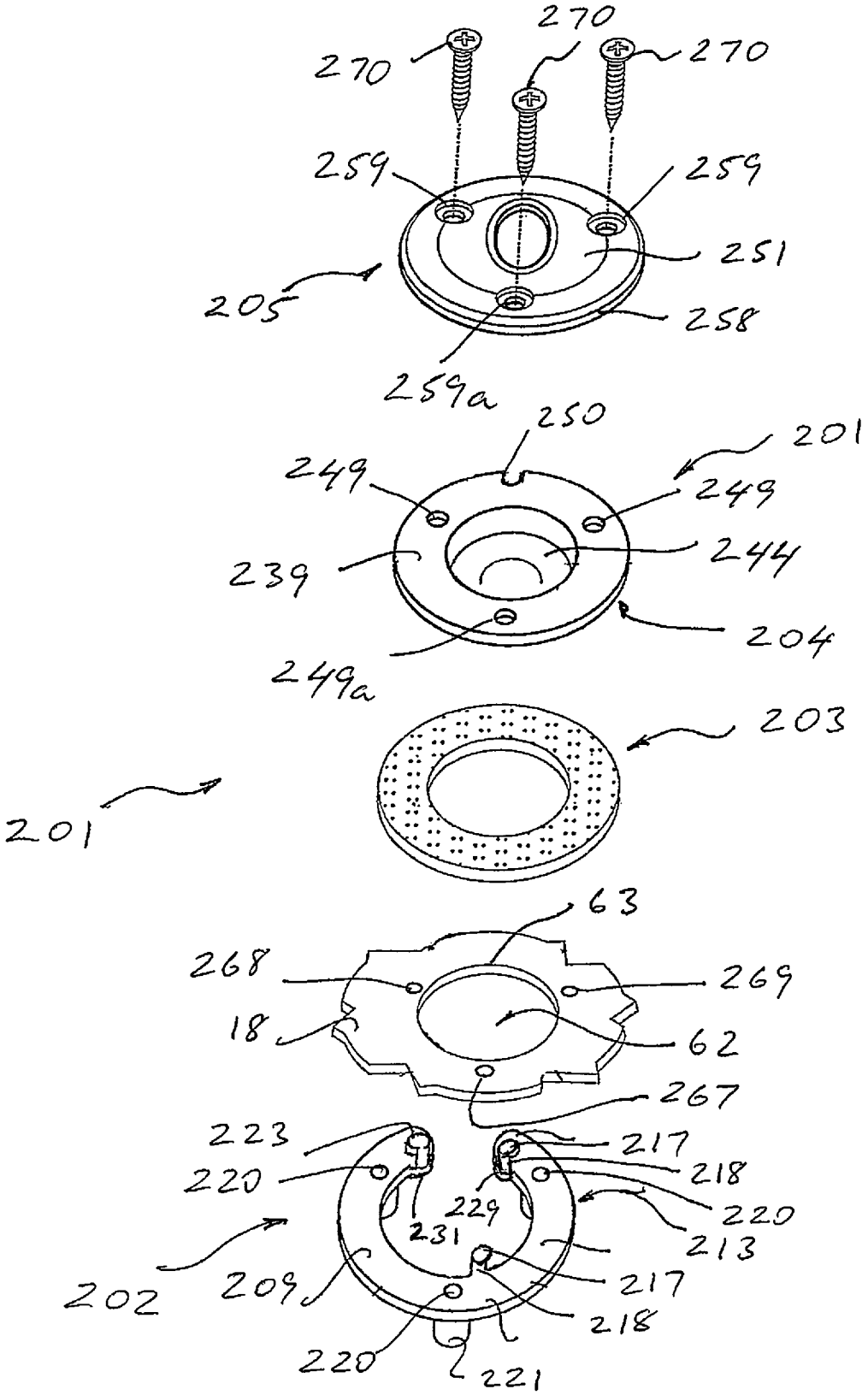
FIG. 55 is a perspective exploded view of the second fitting for creating a recess in a wall of a hull of a watercraft constructed in accordance with the present invention.
Figure 56:
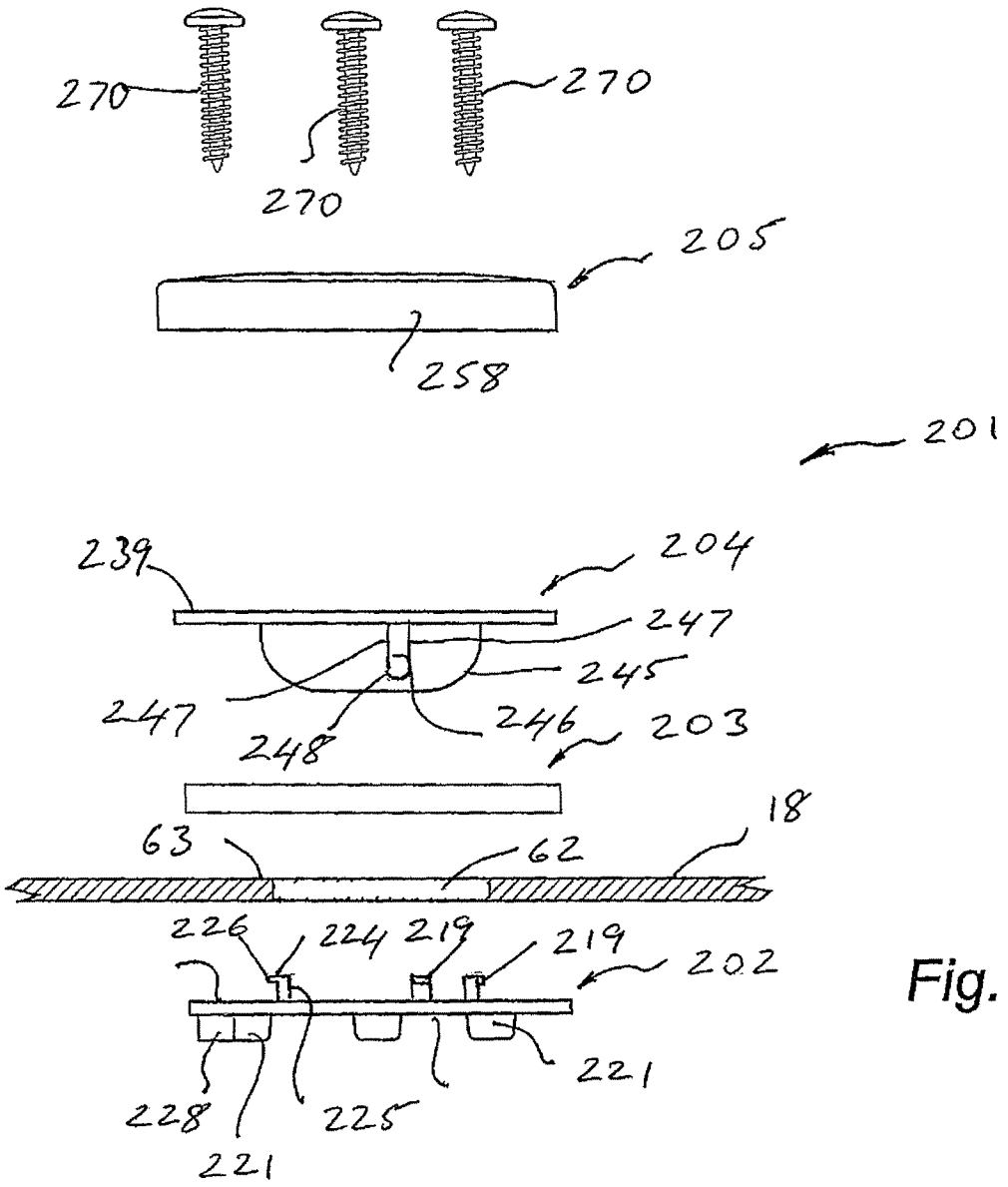
FIG. 56 is a side view of the second fitting for creating a recess in a wall of a hull of a watercraft eat recess assembly shown apart and in line for assembly.
Figure 57:
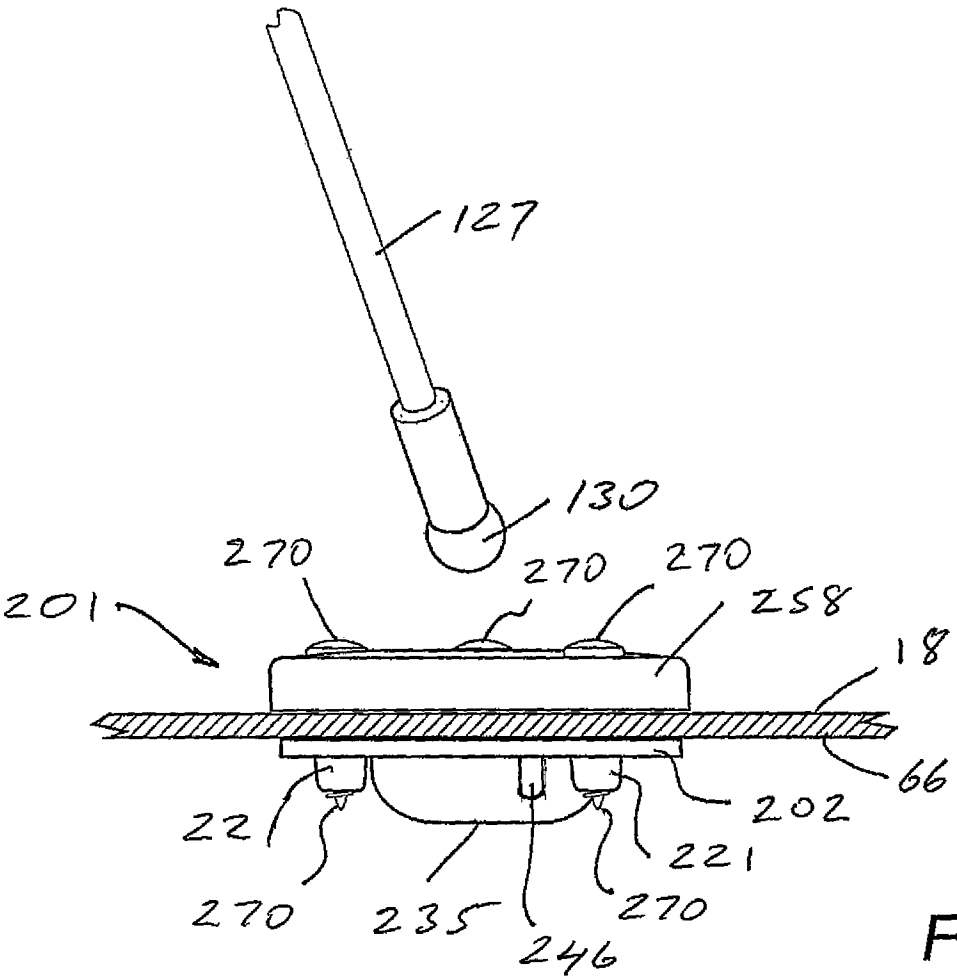
FIG. 57 is a side view of the second fitting for creating a recess in a wall of a hull of a watercraft when assembled.
Figure 58:
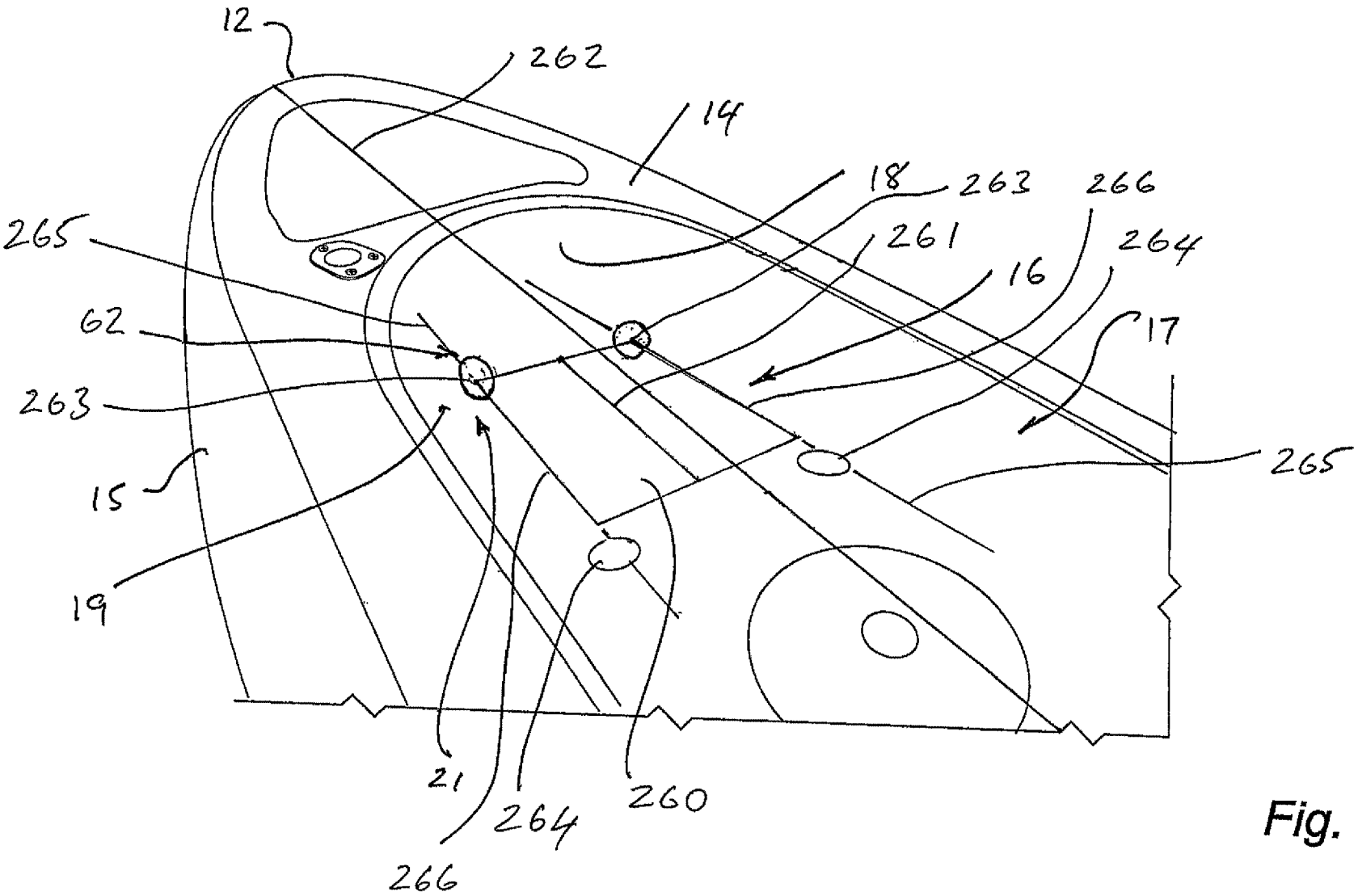
FIG. 58 is a pictorial view of a kayak and a template that may be used to correctly position apertures formed in the kayak that are for receiving a fitting for creating a recess in a wall of a hull of a watercraft.

The fitting 70 is adapted to operatively engage with a male strap connector 85 of the type shown in FIG. 27. The strap connector 85 includes a generally triangular shaped body 86 in which there is formed an elongate opening 87 that is located adjacent one end of the body, namely the base of the triangle. The opening 87 is adapted to receive a strap passed therethrough.

The connector 85 also includes a generally spherically shaped head portion 88, that is connected to the apex of the triangularly shaped body 86 by an intermediate stem 89.

Preferably the male and female strap connectors 70 and 85 are made of a plastics material. For example, the male and female strap connectors may be made of nylon. Further to provide strength and rigidity, fibreglass may be added to the nylon.

Preferably the female strap connector 70 is made from a material comprising 85% nylon and 15% fibreglass.

Further, because the stem of the male strap connector 85 may get bent when locating the head portion 88 in the mouth 77 of the female strap connector 70, it is preferred that the male strap connector is manufactured from a resilient plastics material, such as nylon.

FIGS. 1 to 5, 7 and 9 show a removable kayak seat 110 having a backrest 111 and a seat base 112. The backrest 111 includes a top edge portion 113 and an opposing bottom edge portion 114, and two side edge portions or wings 115 that are connected to the top and bottom edge portions.

The seat base 112 includes a front edge portion 116 and a rear edge portion 117, and two opposing side edge portions 118 that are connected to said front edge portion 116 and to said rear edge portion 117. Further, the rear edge portion 117 of the seat base 112 is hingedly connected to the bottom edge portion 114 of the backrest 111 generally along line 119.

The backrest 111 includes two backrest support assemblies 120 that provide support for the backrest and help maintain the general shape of the backrest. Each backrest support assembly 120 includes a strap adjuster buckle connector 121 having a generally cylindrically shaped, tubular mounting portion 122 that is closed at one end and a flange 123 that extends outwardly and away from the closed end of said mounting portion 122.

The strap adjuster buckle connector 121 also includes two opposing protrusions 124 that extend upwardly from the flange 123 and which are located adjacent the closed end of the mounting portion 122. Each protrusion 124 includes a generally hemispherical recess 125 and whereby the two recesses 125 in combination define a socket 126.

Each backrest support assembly 120 also includes an elongate stiffening member 127 having a generally circular cross section. One end of the stiffening member is retained in the tubular mounting portion 122 of the strap adjuster buckle connector 121, while a stopper 128 is secured to the other end.

The stopper 128 includes a tubular mounting portion 129 and a generally spherically shaped end portion 130.

The stiffening member 127 is retained within a tubular pocket formed in the backrest 111 and whereby a lower portion of the stiffening member, to which the stopper 128 is attached, extends through an opening 131 in said pocket adjacent the bottom edge portion 114.

The strap adjuster buckle connector 121 is also mostly contained within the backrest 111 with only the socket 126 protruding through an opening 132 adjacent the top edge portion 113.

FIGS. 10 to 13 show a strap adjuster buckle 135 having a generally rectangular shaped body 136 in which there is formed two elongate slots 137*a* and 137*b* through which a strap in use may extend.

The strap adjuster buckle 135 also includes a generally spherically shaped head portion 138 that is connected to a triangular shaped end portion 139 of the body 136 by a resilient stem 140 and a flange 210 extending outwardly therefrom. The head portion 140 is in use retained in the socket 126 such that the strap adjuster buckle 135 may pivot relative to the strap adjuster buckle connector 121 and whereby rotation of the strap adjuster buckle 135 relative to the socket 126 is prevented by the flange 210 that, in use, is located between opposing protrusions 124.

The strap adjuster buckle 135 also includes an arcuate tab 170 that is connected to an opposite end of the body 136 to which the head portion 138 is connected to. The curved face 171 is adapted to engage a user's finger, as shown in FIG. 9.

Figure 9:
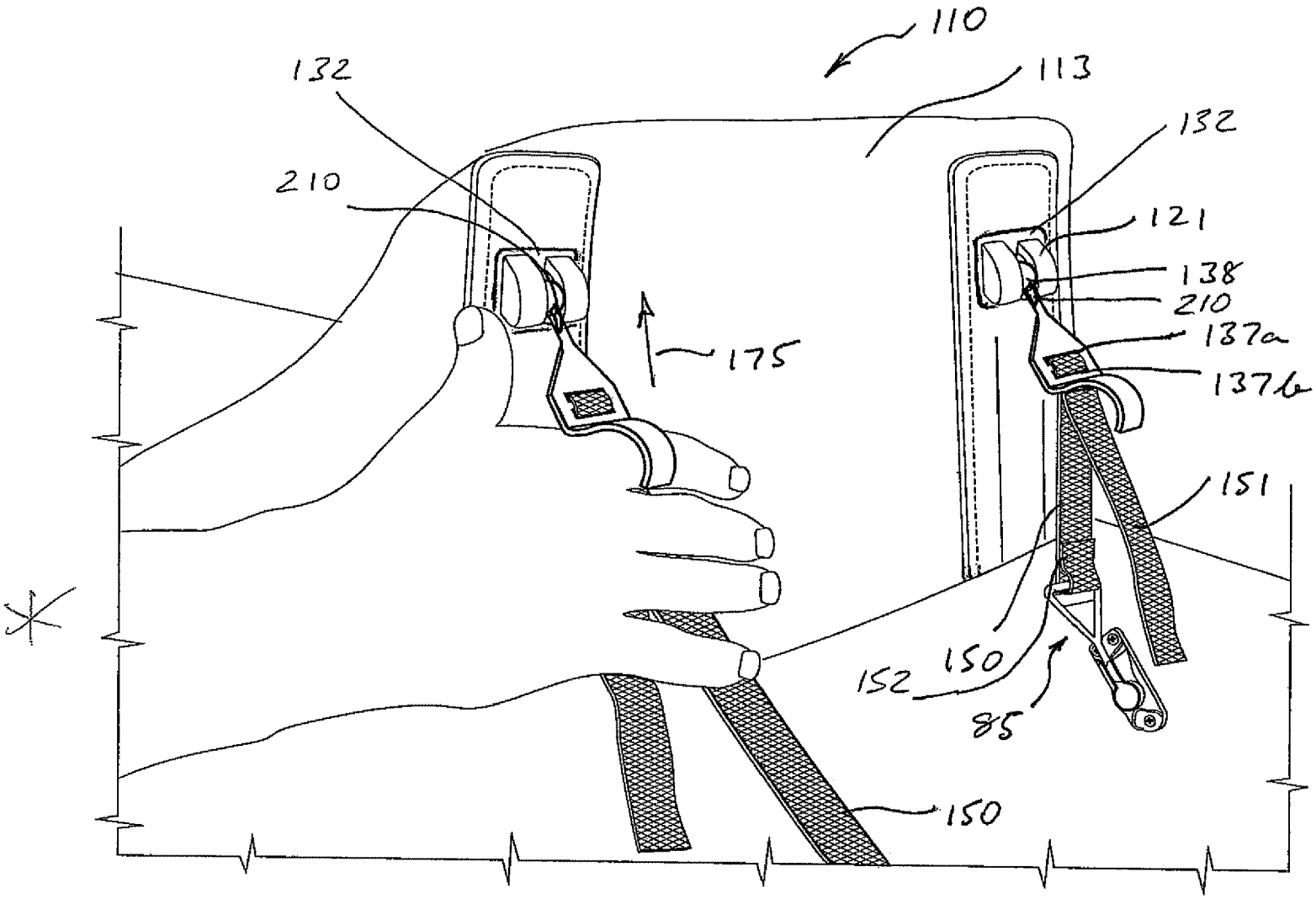
FIG. 9 is a rear pictorial view of a kayak seat showing straps that are used to maintain the seat in an operable position on the kayak.
Figures 10, 11, 12, 13, 14, 15, 16, 17:
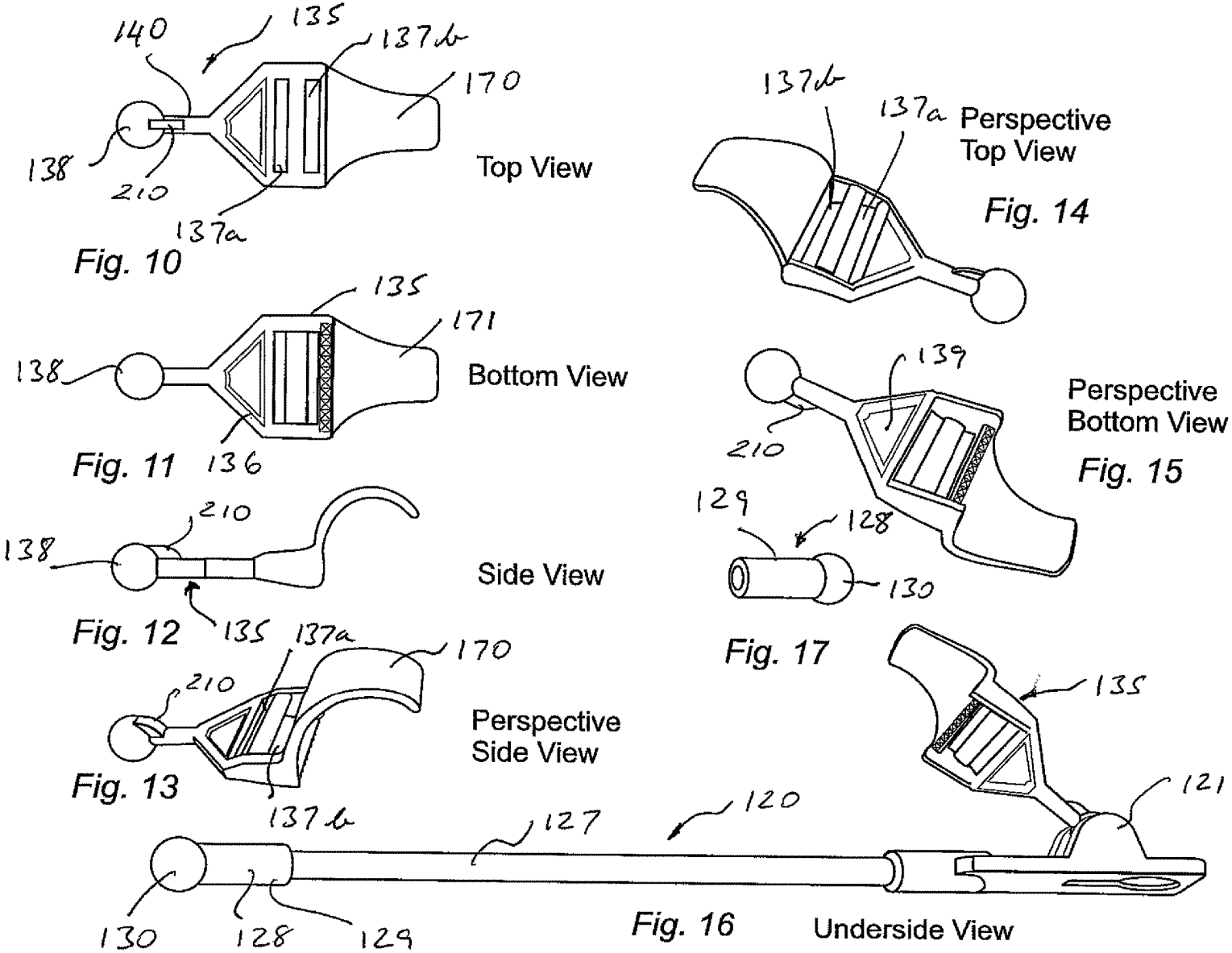
FIG. 10 is a top view of a strap adjuster buckle that has been constructed in accordance with the present invention.
FIG. 11 is a bottom view of the strap adjuster buckle shown in FIG. 10.
FIG. 12 is a side view of the strap adjuster buckle shown in FIG. 10.
FIG. 13 is perspective side view of the strap adjuster buckle shown in FIG. 10.
FIG. 14 is a perspective top view of the strap adjuster buckle shown in FIG. 10.
FIG. 15 is a perspective bottom view of the strap adjuster buckle shown in FIG. 10.
FIG. 16 is a pictorial side view of structural means, namely, a backrest support assembly that has been constructed in accordance with the present invention.
FIG. 17 is a pictorial side view of a stopper.
Figure 21:
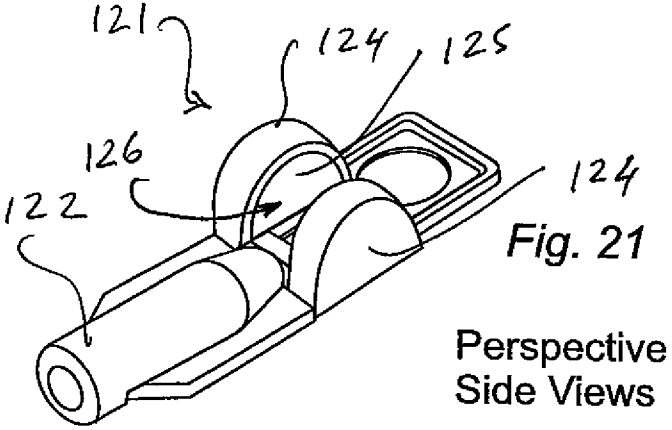
FIG. 21 is a perspective side view of the strap adjuster buckle connector shown in FIG. 18.
Figure 22:
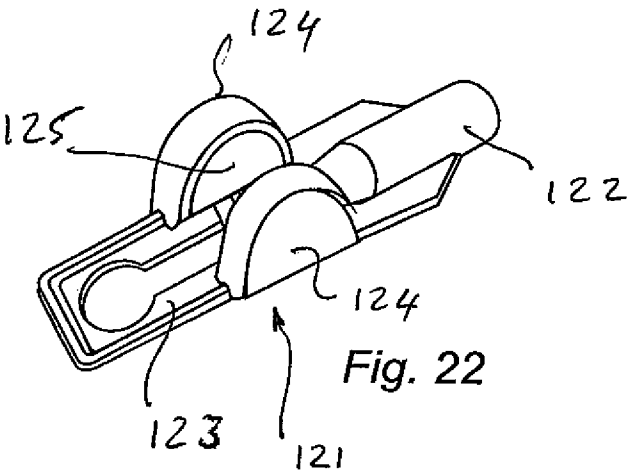
FIG. 22 is a perspective side view of the strap adjuster buckle connector shown in FIG. 18.
Figure 18:
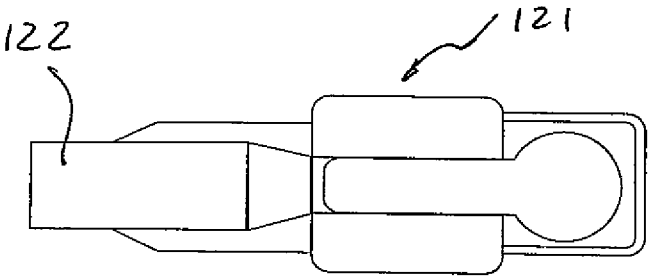
FIG. 18 is a top view of a strap adjuster buckle connector that has been constructed in accordance with the present invention.
Figure 19:
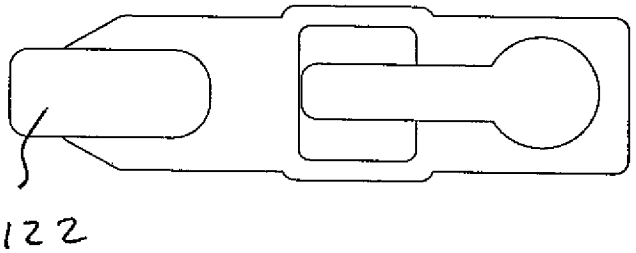
FIG. 19 is a bottom view of the strap adjuster buckle connector shown in FIG. 18.
Figure 20:
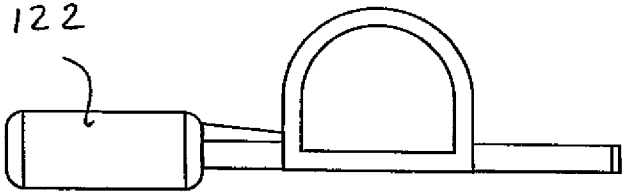
FIG. 20 is a side view of the strap adjuster buckle connector shown in FIG. 18.
Figure 25:
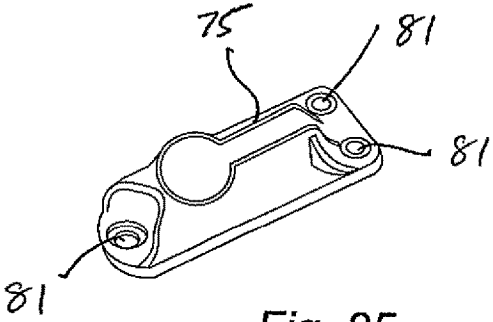
FIG. 25 is a perspective front view of the fitting shown in FIG. 23.
Figure 26:
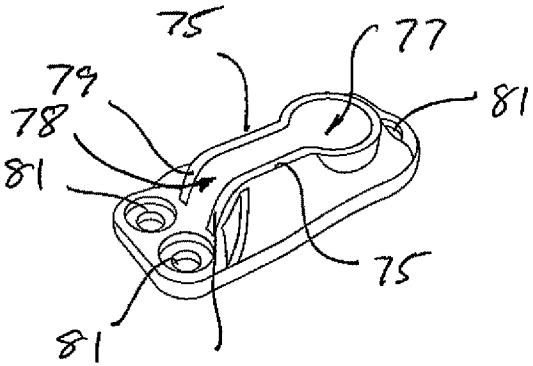
FIG. 26 is a perspective rear view of the fitting shown in FIG. 23.
Figure 23:
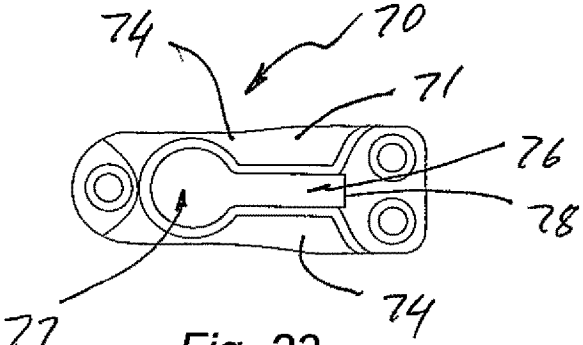
FIG. 23 is a top view of a female strap connector or fitting that has been constructed in accordance with the present invention.
Figure 24:
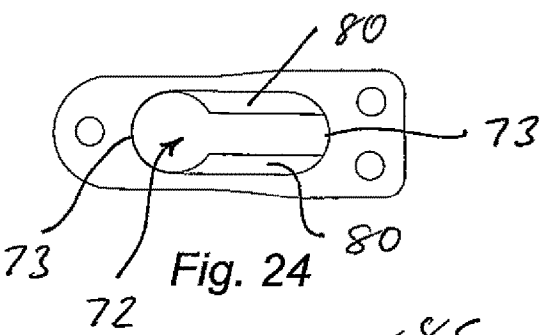
FIG. 24 is a bottom view of the fitting shown in FIG. 23.

The backrest 111 further includes two rearwardly extending straps 150 each having a free end 151 that has been threaded through firstly slot 137*a* and then through slot 137*b*, as shown in FIG. 9 in particular.

The other end 152 of the strap 150 is connected to a strap connector 85. The end portion 152 having been threaded through a slot 87, has been folded back upon itself and secured to the strap 150 so as to form a connecting loop. Alternatively, the strap end 152, having been threaded through the slot 87 may be secured to a buckle or triglide 153, as shown in FIG. 1.

The back rest 111 also includes two forward extending straps 160, each having a free end portion 161 and an opposing fixed end portion 162. Each of the fixed end portions 162 are attached to a respective wing 115 of a kayak seat 110.

Each free end portion 161 is first threaded through two adjacent slotted openings 156*a* and 156*b* of a strap adjuster buckle 155, and then through slotted opening 87 of a strap connector 85. The free end is then threaded again through opening 156*b*, from the opposite side of the buckle than before, and is then threaded through opening 156*c*.

In use, The kayak seat 110 may be secured to a kayak 10 by firstly extending a stopper 128 through the oval shaped opening 60 of a respective seat recess assembly 21 such that the spherically shaped end portion 130 bears against the bottom face 44 of the plug 24 and whereby the stiffening member 127 may pivot relative to the seat recess assembly 21 in a generally forward and aft direction as governed by the generally straight side edges 60*a* of the opening 60. As a consequence, the seat base 112 will generally overlie a portion of the seat portion 16 and the backrest will extend generally upwardly from the seat base 112.

Each of the forwarding extending straps 160 may then be secured to a respective fitting 70 mounted on the kayak both adjacent and forward to the side edge portion 115 by firstly placing the spherically shaped head portion 88 of the strap connector 85 in the generally complementary shaped mouth 77 of the fitting 70, and then pulling the head portion in a generally rearward direction such that the head portion 88 is retained behind the edge portions 75 and the stem 89 extends through the slot 76 and is ultimately retained within the opening 78. Further, contact between the curved surface of the head portion 88 and the curved faces 88 of the edge portions 75 will allow the strap connector to rotate relative to the fitting. Thus, the orientation of the strap connector 85 relative to the fitting is not particularly important when engaging the strap connector with the fitting.

The strap adjuster buckles 155 allow the user to vary the effective length of the forward straps 160 and, in doing so, vary the angle of inclination of the backrest 111 relative to the seat base 112.

Each of the rearward extending straps 150 may be secured to a respective fitting 70 mounted on the kayak both adjacent to and generally rearward of the backrest 111 by firstly placing the spherically shaped head portion 88 of the strap connector 85 in the generally complementary shaped mouth 77 of the fitting 70, and then pulling the head portion in a generally rearward direction such that the head portion 88 is retained behind the edge portions 75 and the stem 89 extends through the slot 76 and is ultimately retained within the opening 78. Further, contact between the curved surface of the head portion 88 and the curved faces 80 of the edge portions 75 will allow the strap connector to rotate relative to the fitting. Thus, the orientation of the strap connector 85 relative to the fitting is not particularly important when engaging the strap connector with the fitting.

Then, by pulling on the free end 151 of each strap 150 such that the portion of each strap 150 extending between the strap connector 85 and the strap adjuster buckle 135 becomes taught, a force will be applied to the top portion 113 of the seat 110 sufficient to pull the back rest support assembly 120 to which it is connected generally downward such that the spherical end portion 130 of the stopper 128 is firmly retained, or anchored, within the recess 46 of the plug 24.

In order to remove the kayak seat 110 from the kayak 10, the user may first push back against the strap adjuster buckle 135 in the general direction of arrow 175, as shown in FIG. 9. This will release the tension on the portion of the strap 150 between the strap connector 85 and the strap adjuster buckle 135, thereby enabling the user to disengage the strap connector 85 that is attached thereto from the fitting 70 that it is temporarily connected to.

Once the two rearwardly extending straps 150 have been disconnected from the kayak 10, the user may tilt the kayak seat 110 generally forward, such as by lifting the stoppers 128 free from their respective plugs 24. This will ease the tension on the two forward extending straps 160 thereby allowing the user to disconnect them strap connectors 85 to which they are attached from the fittings 70 to which they have been temporarily attached.

In other embodiments the kayak may be constructed with recesses that are each adapted to receive a respective end portion of stiffening means of a kayak seat, such as a stopper 128. Further, in order to prevent wear on the recess creating a hole in the kayak it is envisaged that a plug made from a harder, more durable, plastics material may be inserted in the recess and whereby the plug will be adapted to receive the end portion of a stiffening member.

For example, the recess may have a generally square shaped cross-section and inwardly tapering walls and wherein the outer walls of the plug may include barbs that will engage the walls of the recess and resist separation of the plug from the recess.

It will of course be realised that while the foregoing description has been given by way of example of the invention, all other modifications and variations thereto as would be apparent to persons skilled in the art are deemed to fall within the broad scope and ambit of this invention as herein defined in the appended claims.

The claims defining the invention are as follows:

1. A removable seat, for a watercraft of the type having a hull or underside and a deck, and wherein the deck is connected to the hull by side portions or rails, and said deck includes retaining means in the form of one or more recesses formed in or attached to the deck, said seat including:

a seat base;

a backrest that is connected to said seat base such that said backrest may generally pivot relative to said seat base;

structural means associated with said back rest for maintaining a preferred shape of said backrest;

anchoring means connected to said structural means, said anchoring means extending generally away from a lower portion of said backrest and a rear portion of said seat base, said anchoring means having a distal end portion that is generally spherical in shape, said distal end portion being locatable within the retaining means and capable of limited pivotal movement relative thereto;

first releasable securing means connected to an upper portion of said backrest and connectable to a location on the deck or the rails generally forward of said seat, and second releasable securing means connected to an upper portion of said backrest and connectable to a location on the deck or the rails generally rearward of said seat.

2. A removable seat as claimed in claim 1, wherein said structural means includes two opposing, elongate, stiffening members that each depend from a top portion of said backrest towards said seat base and wherein said anchoring means includes a lower portion of each of said stiffening members, and wherein said lower portion of each of said stiffening members extends generally away from said lower portion of said backrest and said rear portion of said seat base and wherein said lower portions of each of said stiffening members includes a distal end portion that is generally spherical in shape and which is locatable within a respective one of said recesses.

3. A removable seat as claimed in claim 2, wherein said backrest includes two opposing side portions and said first releasable securing means includes two straps that are each connected to a respective side portion and wherein the effective length of each of said straps is adjustable.

4. A removable seat as claimed in claim 3, wherein each of said straps includes a connector for releasably connecting said strap to the deck or side rails.

5. A removable seat as claimed in any one of claim 2 to claim 4, wherein said second releasable securing means includes at least one strap and wherein the effective length of said strap is adjustable.

6. A removable seat as claimed in claim 5, wherein said strap includes a connector for releasably connecting said strap to the deck or side rails.

7. A watercraft having a removable seat, said watercraft including:

a hull or underside having a bow at a forward end and a stern at an opposite end;

a deck that is connected to said hull by side portions or rails;

retaining means in the form of one or more recesses formed in or attached to said deck;

a seat base supported on said deck;

a backrest that is connected to said seat base such that said backrest may generally pivot relative to said seat base;

structural means associated with said backrest for maintaining a preferred shape of said backrest;

anchoring means connected to said structural means, said anchoring means extending generally away from a lower portion of said backrest and a rear portion of said seat base, said anchoring means being locatable within said retaining means, first releasable securing means extending generally in a forward direction towards the bow and connected to an upper portion of said backrest and to said deck or said rails, and second releasable securing means extending generally in a rearward direction towards the stern and connected to an upper portion of said backrest and to said deck or said rails.

8. A watercraft as claimed in claim 7, wherein said structural means includes two opposing, elongate, stiffening members that each extend from a top portion of said backrest towards said seat base and wherein said anchoring means includes a lower portion of each of said stiffening members, which are located within a respective one of said recesses.

9. A watercraft as claimed in claim 8, wherein said backrest includes two opposing side portions and said first releasable securing means includes two straps that are each connected to a respective side portion and wherein the effective length of each of said straps is adjustable.

10. A watercraft as claimed in claim 9, wherein each of said straps includes a connector for releasably connecting said strap to said deck or one of said rails.

11. A watercraft as claimed in claim 10, wherein said second releasable securing means includes at least one strap and wherein the effective length of said strap is adjustable.

12. A watercraft as claimed in claim 11, wherein said strap includes a connector for releasably connecting said strap to the deck or a rail.

13. A method of assembling a watercraft, said method including:

providing a watercraft having:

a hull or underside having a bow at a forward end and a stern at an opposite end;

a deck that is connected to said hull by opposing side portions or rails;

a seat portion on which a paddler may sit, said seat portion being formed in or attached to said deck and wherein said seat portion includes a peripheral edge portion;

and a recess for a removable seat, said recess being in the deck and located either adjacent to or in said seat portion;

providing a removable seat having a backrest that includes structural means for maintaining the shape of the backrest, a seat base that is connected to the backrest, and forward and aft stays each having one end that is connected to the backrest and a free end having connecting means, said seat further including anchoring means for securing the removable seat to the watercraft, said anchoring means including:

a body having a first engagement portion that is connected to the structural means of the back rest, and a second engagement portion that extends generally away from a lower portion of the backrest and a rear portion of the seat base, said second engagement portion being receivable within the recess of the watercraft;

locating the second engagement portion in the recess;

securing the free ends of the forward and aft stays to the deck or rails using the connecting means.

* * * * *